US009256185B2

(12) United States Patent
Habu

(10) Patent No.: US 9,256,185 B2
(45) Date of Patent: Feb. 9, 2016

(54) PRINTING CONTROL DEVICE, IMAGE FORMING SYSTEM, AND NON-TRANSITORY COMPUTER-READABLE MEDIUM

(71) Applicant: Yuichi Habu, Ibaraki (JP)

(72) Inventor: Yuichi Habu, Ibaraki (JP)

(73) Assignee: RICOH COMPANY, LIMITED, Tokyo (JP)

( * ) Notice: Subject to any disclaimer, the term of this patent is extended or adjusted under 35 U.S.C. 154(b) by 0 days.

(21) Appl. No.: 14/468,919

(22) Filed: Aug. 26, 2014

(65) Prior Publication Data

US 2015/0063854 A1 Mar. 5, 2015

(30) Foreign Application Priority Data

Aug. 28, 2013 (JP) ..... 2013-177333

(51) Int. Cl.
*G03G 15/00* (2006.01)
*G03G 15/01* (2006.01)

(52) U.S. Cl.
CPC ..... *G03G 15/6585* (2013.01); *G03G 15/01* (2013.01); *G03G 15/50* (2013.01)

(58) Field of Classification Search
CPC G03G 15/01; G03G 15/6582; G03G 15/6585
See application file for complete search history.

(56) References Cited

U.S. PATENT DOCUMENTS

2012/0062956 A1 3/2012 Kitagawa et al.
2012/0063802 A1 3/2012 Suzuki et al.
2013/0063740 A1 * 3/2013 Mochizuki ..... 358/1.9

FOREIGN PATENT DOCUMENTS

JP 2012-083736 4/2012

* cited by examiner

*Primary Examiner* — Clayton E Laballe
*Assistant Examiner* — Ruifeng Pu
(74) *Attorney, Agent, or Firm* — Oblon, McClelland, Maier & Neustadt, L.L.P.

(57) ABSTRACT

A printing control device includes a receiving unit and a replacing unit. The receiving unit receives a print job, which includes gloss control printing data indicating a type of surface effect by predetermined density information and table information capable of identifying a surface-effect selection table used in creation of the gloss control printing data, from a host device. The replacing unit replaces a part or whole of the surface-effect selection table implemented in the printing control device in advance on the basis of the table information included in the print job.

14 Claims, 15 Drawing Sheets

| NAME OF GLOSS CONTROL | GLOSS | DEVIATION |
|---|---|---|
| SPECULAR GLOSS (PG) | Gs≥80 | ΔGs≤10 |
| SOLID GLOSS (G) | Gs=Gs (SOLID GLOSS) | ΔGs≤10 |
| HALFTONE MATT (M) | Gs=Gs (1C 30% HALFTONE) | ΔGs≤10 |
| MATT (PM) | Gs≤10 | ΔGs≤10 |

| TYPE OF SURFACE EFFECT SPECIFIED BY USER | DENSITY VALUE OF GLOSS CONTROL PRINTING (%) |
|---|---|
| PG | 98% |
| G | 90% |
| M | 16% |
| PM | 6% |

FIG.12

| DENSITY (%) | DENSITY | | | EFFECT | GLOSSER ON/OFF | CLEAR-TONER PRINTING 1 (PRINTER DEVICE) | CLEAR-TONER PRINTING 2 (LOW-TEMPERATURE FIXING DEVICE) |
|---|---|---|---|---|---|---|---|
| | REPRESENTATIVE VALUE | RANGE OF NUMERICAL VALUES | | | | | |
| 98% | 250 | 248 | 255 | SPECULAR GLOSS TYPE A | ON | INVERSE MASK A | (no data) |
| 96% | 245 | 243 | 247 | SPECULAR GLOSS TYPE B | ON | INVERSE MASK B | (no data) |
| 94% | 240 | 238 | 242 | SPECULAR GLOSS TYPE C | ON | INVERSE MASK C | (no data) |
| 92% | 235 | 233 | 237 | (RESERVED) | – | – | – |
| 90% | 230 | 228 | 232 | SOLID GLOSS TYPE 1 | OFF | INVERSE MASK 1 | (no data) |
| 88% | 224 | 222 | 227 | SOLID GLOSS TYPE 2 | OFF | INVERSE MASK 2 | (no data) |
| 86% | 219 | 217 | 221 | SOLID GLOSS TYPE 3 | OFF | INVERSE MASK 3 | (no data) |
| 84% | 214 | 212 | 216 | SOLID GLOSS TYPE 4 | OFF | INVERSE MASK 4 | (no data) |
| 82% | 209 | 207 | 211 | (RESERVED) | – | – | – |
| 54% | 138 | 136 | 140 | USER DEFINITION 03 | OFF | (CREATED BY USER) | (CREATED BY USER) |
| 52% | 133 | 131 | 135 | USER DEFINITION 02 | OFF | (CREATED BY USER) | (CREATED BY USER) |
| 50% | 128 | 126 | 130 | USER DEFINITION 01 | OFF | (CREATED BY USER) | (CREATED BY USER) |
| 48% | 122 | 120 | 125 | (RESERVED) | – | – | – |
| 46% | 117 | 115 | 119 | (RESERVED) | – | – | – |
| 44% | 112 | 110 | 114 | WATERMARK TEXT 3 (INTERNAL USE ONLY) | OFF | (no data) | TILE CHARACTER STRING 3 |
| 42% | 107 | 105 | 109 | WATERMARK TEXT 2 (COPY STRICTLY PROHIBITED) | OFF | (no data) | TILE CHARACTER STRING 2 |
| 40% | 102 | 100 | 104 | WATERMARK TEXT 1 (SPECIMEN) | OFF | (no data) | TILE CHARACTER STRING 1 |
| 38% | 97 | 95 | 99 | (RESERVED) | – | – | – |
| 36% | 92 | 90 | 94 | (RESERVED) | – | – | – |
| 34% | 87 | 85 | 89 | WOVEN PATTERN 3 (STAR) | OFF | (no data) | TILE WOVEN PATTERN 3 |
| 32% | 82 | 80 | 84 | WOVEN PATTERN 2 (LATTICE) | OFF | (no data) | TILE WOVEN PATTERN 2 |
| 30% | 76 | 74 | 79 | WOVEN PATTERN 1 (WAVE) | OFF | (no data) | TILE WOVEN PATTERN 1 |
| 28% | 71 | 69 | 73 | (RESERVED) | – | – | – |
| 26% | 66 | 64 | 68 | (RESERVED) | – | – | – |
| 24% | 61 | 59 | 63 | TACTILE PATTERN TYPE 3 (ROUGH) | OFF | (no data) | TILE RETICULAR PATTERN 3 |
| 22% | 56 | 54 | 58 | TACTILE PATTERN TYPE 2 (MODERATE) | OFF | (no data) | TILE RETICULAR PATTERN 2 |
| 20% | 51 | 49 | 53 | TACTILE PATTERN TYPE 1 (FINE) | OFF | (no data) | TILE RETICULAR PATTERN 1 |
| 18% | 46 | 44 | 48 | (RESERVED) | – | – | – |
| 16% | 41 | 39 | 43 | HALFTONE MATT TYPE 4 | OFF | HALFTONE 4 | (no data) |
| 14% | 36 | 34 | 38 | HALFTONE MATT TYPE 3 | OFF | HALFTONE 3 | (no data) |
| 12% | 31 | 29 | 33 | HALFTONE MATT TYPE 2 | OFF | HALFTONE 2 | (no data) |
| 10% | 25 | 23 | 28 | HALFTONE MATT TYPE 1 | OFF | HALFTONE 1 | (no data) |
| 8% | 20 | 18 | 22 | (RESERVED) | – | – | – |
| 6% | 15 | 13 | 17 | MATT TYPE C | ON&OFF | (no data) | SOLID |
| 4% | 10 | 8 | 12 | MATT TYPE B | ON&OFF | (no data) | SOLID |
| 2% | 5 | 1 | 7 | MATT TYPE A | ON&OFF | (no data) | SOLID |
| 0% | 0 | 0 | 0 | N/A | OFF | (no data) | (no data) |

FIG.13

| DENSITY (%) | DENSITY | | | EFFECT | GLOSSER ON/OFF | CLEAR-TONER PRINTING 1 (PRINTER DEVICE) | CLEAR-TONER PRINTING 2 (LOW-TEMPERATURE FIXING DEVICE) |
|---|---|---|---|---|---|---|---|
| | REPRESENTATIVE VALUE | RANGE OF NUMERICAL VALUES | | | | | |
| 98% | 250 | 248 | 255 | SPECULAR GLOSS TYPE A | ON | INVERSE MASK A | (no data) |
| 96% | 245 | 243 | 247 | SPECULAR GLOSS TYPE B | ON | INVERSE MASK B | (no data) |
| 94% | 240 | 238 | 242 | SPECULAR GLOSS TYPE C | ON | INVERSE MASK C | (no data) |
| 92% | 235 | 233 | 237 | (RESERVED) | – | – | – |
| 90% | 230 | 228 | 232 | SOLID GLOSS TYPE 1 | OFF | INVERSE MASK 1 | (no data) |
| 88% | 224 | 222 | 227 | SOLID GLOSS TYPE 2 | OFF | INVERSE MASK 2 | (no data) |
| 86% | 220 | 220 | 221 | SOLID GLOSS TYPE 3 | OFF | INVERSE MASK 3 | (no data) |
| 85% | 218 | 217 | 219 | SOLID GLOSS TYPE 4 | OFF | INVERSE MASK 4 | (no data) |
| 84% | 215 | 215 | 216 | SOLID GLOSS TYPE 5 | OFF | INVERSE MASK 5 | (no data) |
| 83% | 213 | 212 | 214 | SOLID GLOSS TYPE 6 | OFF | INVERSE MASK 6 | (no data) |
| 82% | 209 | 207 | 211 | (RESERVED) | – | – | – |
| 54% | 138 | 136 | 140 | USER DEFINITION 03 | OFF | (CREATED BY USER) | (CREATED BY USER) |
| 52% | 133 | 131 | 136 | USER DEFINITION 02 | OFF | (CREATED BY USER) | (CREATED BY USER) |
| 50% | 128 | 126 | 130 | USER DEFINITION 01 | OFF | (CREATED BY USER) | (CREATED BY USER) |
| 48% | 122 | 120 | 125 | (RESERVED) | – | – | – |
| 46% | 117 | 115 | 119 | (RESERVED) | – | – | – |
| 44% | 112 | 110 | 114 | WATERMARK TEXT 6 (STRICTLY CONFIDENTIAL) | OFF | (no data) | TILE CHARACTER STRING 6 |
| 42% | 107 | 105 | 109 | WATERMARK TEXT 5 (REFERENCE ONLY) | OFF | (no data) | TILE CHARACTER STRING 5 |
| 40% | 102 | 100 | 104 | WATERMARK TEXT 4 (SAMPLE) | OFF | (no data) | TILE CHARACTER STRING 4 |
| 38% | 97 | 95 | 99 | (RESERVED) | – | – | – |
| 36% | 92 | 90 | 94 | (RESERVED) | – | – | – |
| 34% | 87 | 85 | 89 | WOVEN PATTERN 3 (STAR) | OFF | (no data) | TILE WOVEN PATTERN 3 |
| 32% | 82 | 80 | 84 | WOVEN PATTERN 2 (LATTICE) | OFF | (no data) | TILE WOVEN PATTERN 2 |
| 30% | 76 | 74 | 79 | WOVEN PATTERN 1 (WAVE) | OFF | (no data) | TILE WOVEN PATTERN 1 |
| 28% | 71 | 69 | 73 | (RESERVED) | – | – | – |
| 26% | 66 | 64 | 68 | (RESERVED) | – | – | – |
| 24% | 61 | 59 | 63 | TACTILE PATTERN TYPE 3 (ROUGH) | OFF | (no data) | TILE RETICULAR PATTERN 3 |
| 22% | 56 | 54 | 58 | TACTILE PATTERN TYPE 2 (MODERATE) | OFF | (no data) | TILE RETICULAR PATTERN 2 |
| 20% | 51 | 49 | 53 | TACTILE PATTERN TYPE 1 (FINE) | OFF | (no data) | TILE RETICULAR PATTERN 1 |
| 18% | 46 | 44 | 48 | (RESERVED) | – | – | – |
| 16% | 41 | 39 | 43 | HALFTONE MATT TYPE 4 | OFF | HALFTONE 4 | (no data) |
| 14% | 36 | 34 | 38 | HALFTONE MATT TYPE 3 | OFF | HALFTONE 3 | (no data) |
| 12% | 31 | 29 | 33 | HALFTONE MATT TYPE 2 | OFF | HALFTONE 2 | (no data) |
| 10% | 25 | 23 | 26 | HALFTONE MATT TYPE 1 | OFF | HALFTONE 1 | (no data) |
| 8% | 20 | 18 | 22 | (RESERVED) | – | – | – |
| 6% | 15 | 13 | 17 | MATT TYPE C | ON&OFF | (no data) | SOLID |
| 4% | 10 | 8 | 12 | MATT TYPE B | ON&OFF | (no data) | SOLID |
| 2% | 5 | 1 | 7 | MATT TYPE A | ON&OFF | (no data) | SOLID |
| 0% | 0 | 0 | 0 | N/A | OFF | (no data) | (no data) |

PRINTING CONTROL DEVICE, IMAGE FORMING SYSTEM, AND NON-TRANSITORY COMPUTER-READABLE MEDIUM

CROSS-REFERENCE TO RELATED APPLICATION(S)

The present application claims priority to and incorporates by reference the entire contents of Japanese Patent Application No. 2013-177333 filed in Japan on Aug. 28, 2013.

BACKGROUND OF THE INVENTION

1. Field of the Invention

The present invention relates to a printing control device, an image forming system, and a non-transitory computer-readable medium.

2. Description of the Related Art

Conventionally, there is an image forming apparatus equipped with clear toner, which is colorless toner containing no color material, in addition to four CMYK toners. A toner image formed of such clear toner is fixed on a transfer sheet (an example of a recording medium) on which an image has been formed of CMYK toners, and as a result, a visual or tactile effect (referred to as a surface effect) is achieved on the surface of the transfer sheet. The achieved surface effect differs depending on what kind of a clear-toner image is formed and how the clear-toner image is fixed. There are a surface effect of simply glossing and a surface effect of suppressing the gloss.

Furthermore, not only giving a surface effect on a whole area but also giving a surface effect on only a part and a surface effect of adding a texture or a watermark by means of clear toner are required. Moreover, surface protection may also be required. Furthermore, there is a surface effect that can be achieved by performing post-processing by a dedicated post-processing apparatus, such as a glosser or a low-temperature fixing device, besides the fixing control.

For example, as disclosed in Japanese Patent Application Laid-open No. 2012-083736, there is known a technology to control how to attach clear toner according to gloss control printing data that indicates a type of surface effect to be achieved on a transfer sheet by predetermined density information. In the technology disclosed in Japanese Patent Application Laid-open No. 2012-083736, a host device generates gloss control printing data on the basis of a surface-effect selection table implemented in a DFE (a printing control device), and inputs the generated gloss control printing data to the DFE. The DFE generates clear-toner printing data for attachment of colorless clear toner on the basis of the gloss control printing data input from the host device and the surface-effect selection table implemented in the DFE in advance, and outputs the generated clear-toner printing data.

However, in the technology disclosed in Japanese Patent Application Laid-open No. 2012-083736, the gloss control printing data is created on the basis of the specific surface-effect selection table; therefore, when a printing control device having a different surface-effect selection table from the surface-effect selection table used by the host device to create the gloss control printing data performs printing control based on a print job from the host device, an intended print result cannot be obtained.

Therefore, it is desirable to provide a printing control device, an image forming system, and a non-transitory computer-readable medium capable of obtaining the same level of print result as an expected print result even when gloss control printing data based on a different surface-effect selection table from a pre-implemented surface-effect selection table has been input.

SUMMARY OF THE INVENTION

It is an object of the present invention to at least partially solve the problems in the conventional technology.

According to an aspect of the present invention, there is provided a printing control device controlling a printing device, the printing device being equipped with one or more colored chromatic toners and one or more colorless clear toners and forming an image on a recording medium on the basis of one or more sets of chromatic printing data for attaching the chromatic toners and one or more sets of clear-toner printing data for attaching the clear toners, the printing control device including: a receiving unit that receives a print job from a host device, the print job including gloss control printing data indicating a type of surface effect to be achieved on the recording medium by predetermined density information and table information capable of identifying a surface-effect selection table used in creation of the gloss control printing data, the surface-effect selection table showing a correspondence relation between the type of surface effect and the density information; and a replacing unit that replaces a part or whole of the surface-effect selection table implemented in the printing control device in advance on the basis of the table information included in the print job.

According to another aspect of the present invention, there is provided an image forming system including: a printing control device controlling a printing device, the printing device being equipped with one or more colored chromatic toners and one or more colorless clear toners and controls a printing device which forms an image on a recording medium on the basis of one or more sets of chromatic printing data for attaching the chromatic toners and one or more sets of clear-toner printing data for attaching the clear toners, and a server device that is connected to the printing control device via a network, the image forming system including: a receiving unit that a print job from a host device, the job including gloss control printing data indicating a type of surface effect to be achieved on the recording medium by predetermined density information and table information capable of identifying a surface-effect selection table used in creation of the gloss control printing data, the surface-effect selection table showing a correspondence relation between a type of surface effect and density information and a correspondence relation with clear-toner printing data used in the printing device; and a replacing unit that replaces a part or whole of the surface-effect selection table implemented in the printing control device in advance on the basis of the table information included in the print job.

According to still another aspect of the present invention, there is provided a non-transitory computer-readable medium including computer readable program codes, performed by a printing control device, the printing control device controlling a printer device that is equipped with one or more colored chromatic toners and one or more colorless clear toners and controls a printing device which forms an image on a recording medium on the basis of one or more sets of chromatic printing data for attaching the chromatic toners and one or more sets of clear-toner printing data for attaching the clear toners, the program codes when executed causing the print control device to execute: receiving a print job from a host device, the print job including gloss control printing data indicating a type of surface effect to be achieved on the recording medium by predetermined density information and table information capable of identifying a surface-effect selection table used in creation of the gloss control printing data, from a host device, the surface-effect selection table showing a correspondence relation between a type of surface effect and density information and a correspondence relation with clear-toner printing data used in the printing device; and replacing a part or whole of the surface-effect selection table implemented in the printing control device in advance on the basis of the table information included in the print job.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 12 is a diagram showing an example of the surface-effect selection table;

FIG. 13 is a diagram showing another example of the surface-effect selection table;

DETAILED DESCRIPTION OF THE PREFERRED EMBODIMENTS

Exemplary embodiments of a printing control device, image forming system, and program according to the present invention will be explained in detail below with reference to accompanying drawings.

First Embodiment

Figure 1:
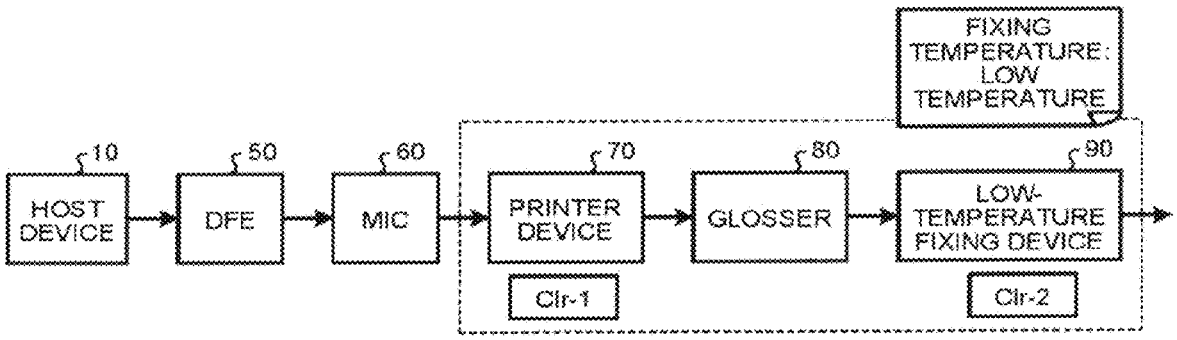
FIG. 1 is a diagram showing an example of a configuration of an image forming system according to a first embodiment.

First, a configuration of an image forming system according to a first embodiment is explained with FIG. 1. In the image forming system according to the present embodiment, a printer control device (a digital front end (DFE)) 50 (hereinafter, referred to as the "DFE 50"), an interface controller (a mechanism I/F controller (MIC)) 60 (hereinafter, referred to as the "MIC 60"), a printer device 70, and a glosser 80 and a low-temperature fixing device 90 provided as post-processing apparatuses are connected. The DFE 50 performs communication with the printer device 70 through the MIC 60, and controls image formation in the printer device 70. Furthermore, a host device 10, such as a personal computer (PC), is connected to the DFE 50. The DEE 50 receives image data from the host device 10, and generates image data for the printer device 70 to form CMYK toner images and a clear-toner image by using the received image data. Then, the DEE 50 transmits the generated image data to the printer device 70 through the MIC 60. The printer device 70 is equipped with at least CMYK and clear toners, respective image forming units for the toners, which each include a photoreceptor, a charging unit, a developing unit, and a photoreceptor cleaner, an exposure unit, and a fixing device.

The clear toner here is transparent (colorless) toner containing no color material. Incidentally, transparent (colorless) indicates, for example, that transmittance is 70% or more.

The printer device 70 causes the exposure unit to emit light beams according to the image data transmitted from the DFE 50 through the MIC 60, thereby forming toner images on the photoreceptors, and transfers the toner images onto a recording medium such as a sheet of paper in a superimposed manner, and then causes the fixing device to fix the toner images on the recording medium by application of heat at a temperature (a normal temperature) within a predetermined range and pressure. Accordingly, an image is formed on a transfer sheet (an example of the recording medium). A configuration of such a printer device 70 is well known, so detailed description of a configuration of the printer device 70 is omitted. The recording medium is not limited to paper, and can be, for example, synthetic paper and plastics, etc.

When the glosser 80 is turned on by on-off control based on on-off information specified by the DFE 50, the glosser 80 pressurizes the image formed on the transfer sheet by the printer device 70 at elevated temperature and pressure, and after that, cools the transfer sheet with the image formed thereon and then peels off the transfer sheet from the main body. Accordingly, pixels to which an excess amount of toners was attached in the whole image formed on the transfer sheet are compressed to equalize a total amount of attached toners. The low-temperature fixing device 90 is equipped with an image forming unit for clear toner, which includes a photoreceptor, a charging unit, a developing unit, and a photoreceptor cleaner, an exposure unit, and a fixing device for fixing the clear toner, and image data for clear toner printing generated by the DFE 50 to use the low-temperature fixing device 90 is input to the low-temperature fixing device 90. When the DFE 50 has generated image data for clear toner printing (clear-toner printing data) for the low-temperature fixing device 90 to use, the low-temperature fixing device 90 forms a clear-toner image by using the clear-toner printing data, and superimposes the clear-toner image on the transfer sheet pressurized by the glosser 80, and then causes the fixing device to fix the clear-toner image on the transfer sheet by application of heat at a lower temperature than normal and pressure.

Here, image data input from the host device 10 is explained. In the host device 10, image data is generated by a pre-installed image processing application (an image processing unit 120, a printing-data generating unit 122, and a print-job generating unit 123, etc.), and the generated image data is transmitted to the DFE 50. In such an image processing application, with respect to image data (in the following description, may be referred to as "chromatic printing data") that defines respective values of density (referred to as density values) of colors in color printing, such as RGB printing or CMYK printing, on a pixel to pixel basis, image data for specific color printing can be handled. The image data for specific color printing is image data for attaching toner or ink in specific colors, such as white, gold, and silver, in addition to basic colors, such as CMYK or RGB, and is data for a printer equipped with such specific color toner or ink. In the specific color printing, to improve the color reproducibility, R can be added to basic CMYK colors, or Y can be added to basic RGB colors. Typically, clear toner has been treated as one of specific colors.

In the present embodiment, clear toner as specific color is used to produce a surface effect which is a visual or tactile effect to be given to a transfer sheet and to form a transparent image, such as a watermark or a texture, besides the above-mentioned surface effect.

Therefore, with respect to input image data, the image processing application of the host device 10 generates image data for gloss control printing and/or image data for clear toner printing as image data for specific color printing in accordance with a designation by a user in addition to chromatic printing data.

Figure 2:
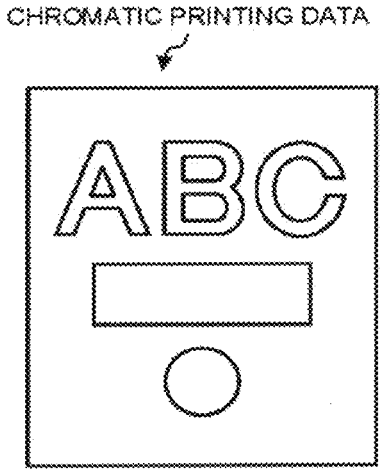
FIG. 2 is a diagram showing an example of image data for chromatic printing.

The chromatic printing data here is image data that defines density values of chromatic colors, such as RGB or CMYK, on a pixel to pixel basis. In this chromatic printing data, each pixel is represented in 8 bits in accordance with a color designation by the user. FIG. 2 is an explanatory diagram showing an example of chromatic printing data. In FIG. 2, with respect to each of drawing objects, such as "A", "B", and "C", respective density values corresponding to colors specified by the user through the image processing application are given.

Furthermore, the image data for gloss control printing (in the following description, may be referred to as "gloss control printing data") is image data that identifies an area of a transfer sheet to be given a surface effect, which is a visual or tactile effect, and a type of the surface effect so as to perform control of attaching clear toner according to the surface effect.

This gloss control printing data is represented in an 8-bit density value in a range of "0" to "255" on a pixel to pixel basis in the same manner as chromatic printing such as RGB and CMYK, and a type of surface effect is associated with this density value (the density value can be represented in a 16 or 32-bit value or a percentage of 0 to 100%). Furthermore, in an area to which one wants to give the same surface effect, the same value is set regardless of the density of actually-attached clear toner; therefore, even if there is no data indicating an area, the area can be easily identified from image data if necessary. That is, a type of surface effect and an area to be given the surface effect are represented by the gloss control printing data (data representing the area can be separately given). Here, the gloss control printing data can be regarded as image data (image information) that a type of surface effect to be achieved on a recording medium is indicated by predetermined density information.

Here, the host device 10 sets a type of surface effect with respect to a drawing object specified by the user through the image processing application as a density value as a gloss control value with respect to each drawing object, and generates a vector form of gloss control printing data.

Pixels composing this gloss control printing data correspond to pixels of the chromatic printing data, respectively. Incidentally, in each image data, a density value of each pixel is a pixel value. Furthermore, the chromatic printing data and the gloss control printing data are both composed of page units.

Figures 3, 4:
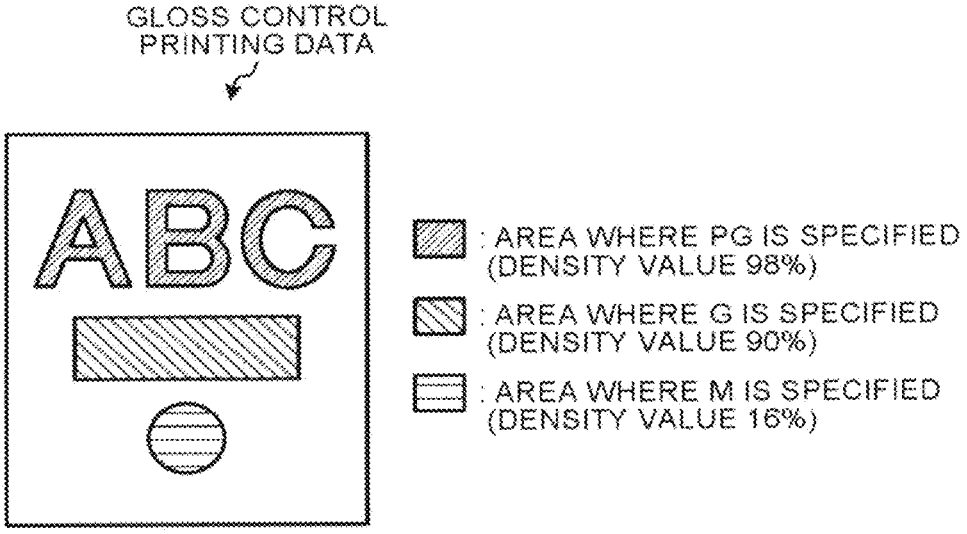
FIG. 3 is a diagram showing an example of types of surface effects relating to the presence or absence of gloss.
FIG. 4 is a diagram representing image data for gloss control printing in an image.

Types of surface effects mainly include the presence or absence of gloss, surface protection, a watermark embedded with information, and a texture, etc. As for surface effects relating to the presence or absence of gloss, as shown in FIG. 3, there are mainly four types: specular gloss (PG: Premium Gloss), solid gloss (G: Gloss), halftone matt (M: Matt), and matt (PM: Premium Matt) in descending order of degree of gloss (gloss level). Hereinafter, specular gloss may be denoted by "PG", solid gloss may be denoted by "G", halftone matt may be denoted by "M", and matt may be denoted by "PM".

Specular gloss and solid gloss are high in degree of glossing; conversely, halftone matt and matt are surface effects for suppressing the gloss, and especially matt achieves a lower gloss level than the gloss level that a normal transfer sheet has. FIG. 3 shows that a gloss level Gs of specular gloss is 80 or more, a gloss level Gs of solid gloss is equal to a solid gloss level of primary color or secondary color, a gloss level Gs of halftone matt is equal to a gloss level of 30% halftone primary color, and a gloss level Gs of matt is 10 or less. Furthermore, deviation of the gloss level is denoted by $\Delta Gs$, and is set to 10 or less. With respect to these types of surface effects, a high density value is associated with a surface effect with a high degree of glossing, and a low density value is associated with a surface effect which suppresses the gloss. An intermediate density value is associated with a surface effect such as a watermark or a texture. As a watermark, for example, characters or a woven pattern, etc. is used. A texture represents characters or a pattern, and can give a tactile effect in addition to a visual effect. For example, a stained-glass pattern can be achieved by clear toner. Specular gloss and solid gloss can serve as surface protection. Incidentally, which area of an image represented by image data to be processed a surface effect is given to or which type of surface effect is given to the area is specified by the user through the image processing application. In the host device 10 that executes the image processing application, as for a drawing object composing an area specified by the user, a density value corresponding to a surface effect specified by the user is set, thereby gloss control printing data is generated. A correspondence relation between density value and type of surface effect will be described later.

FIG. 4 is an explanatory diagram representing an example of gloss control printing data. The example of gloss control printing data in FIG. 4 shows that a surface effect "PG (specular gloss)" is given to a drawing object "ABC", a surface effect "G (solid gloss)" is given to a drawing object "(a rectangular graphic)", and a surface effect "M (halftone matt)" is given to a drawing object "(a circular graphic)" by the user. Incidentally, respective density values set in the surface effects are density values corresponding to types of surface effects defined in a surface-effect selection table to be described later.

Figure 5:
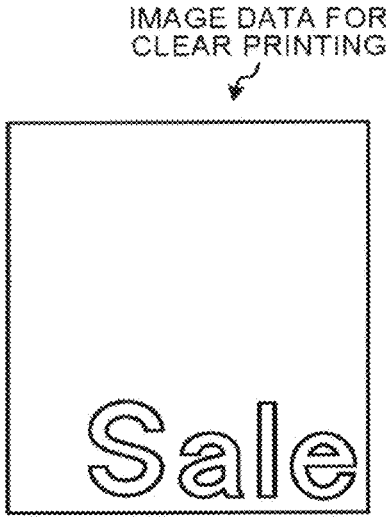
FIG. 5 is a diagram showing an example of image data for clear toner printing.

Image data for clear toner printing is image data that identifies a transparent image, such as a watermark or a texture, other than the above-described surface effects. FIG. 5 is an explanatory diagram showing an example of image data for clear toner printing. In the example shown in FIG. 5, a watermark "Sale" is specified by the user.

In this way, image data for gloss control printing and clear toner printing, which are image data for specific color printing, are generated by the image processing application of the host device 10 on a different plane from a plane of image data for chromatic printing. Furthermore, PDF (Portable Document Format) is used as formats of chromatic printing data, gloss control printing data, and image data for clear toner printing; these PDF image data are integrated and generated as document data. Incidentally, the data format of image data for each printing is not limited to the PDF, and any formats can be used.

Figure 6:
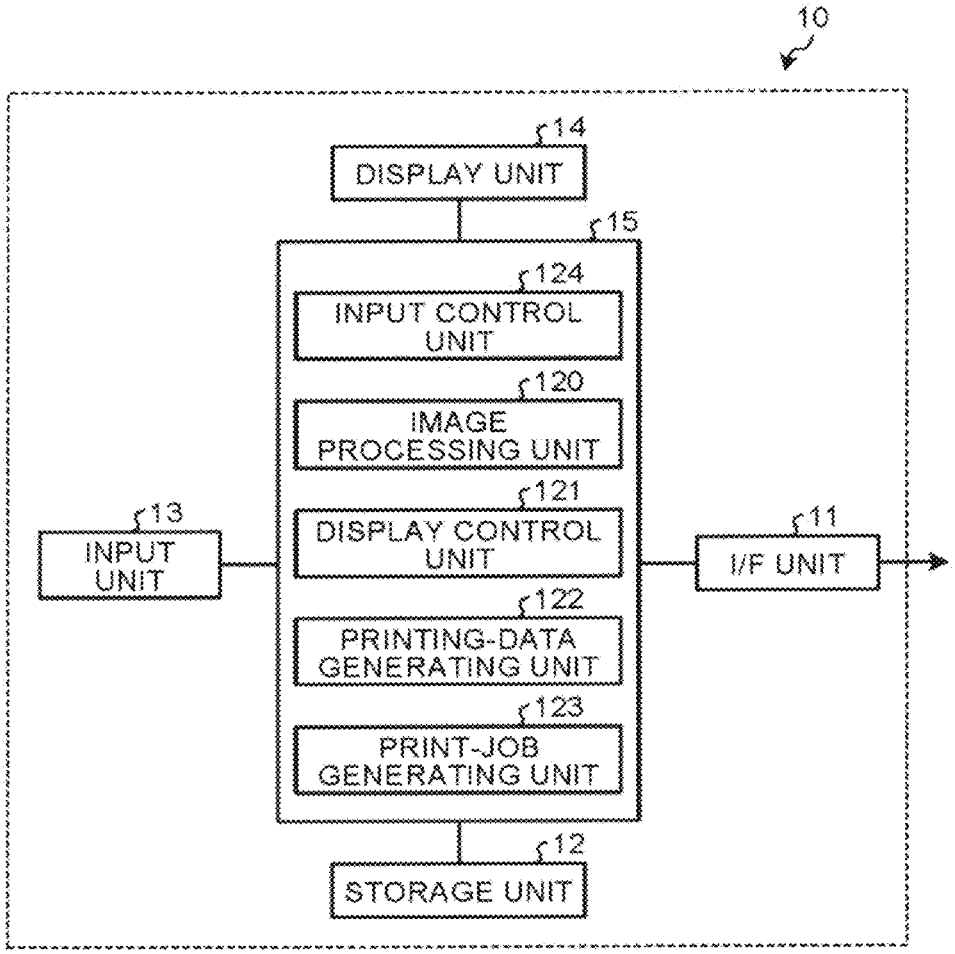
FIG. 6 is a block diagram showing a schematic configuration example of a host device.

Subsequently, details of the host device 10 that generates respective image data for printings are explained. FIG. 6 is a block diagram showing a schematic configuration example of the host device 10. As shown in FIG. 6, the host device 10 includes an I/F unit 11, a storage unit 12, an input unit 13, a display unit 14, and a control unit 15. The I/F unit 11 is an interface device for performing communication with the DFE 50. The storage unit 12 is a storage medium, such as a hard disk drive (HDD) or a memory, that stores therein various data. The input unit 13 is an input device for the user to perform various operation inputs, and can be composed of, for example, a keyboard and a mouse, etc. The display unit 14 is a display device for displaying various screens, and can be composed of, for example, a liquid crystal panel, etc.

The control unit 15 is a computer that controls the entire host device 10 and includes a CPU, a ROM, and a RAM, etc. As shown in FIG. 6, the control unit 15 mainly includes an input control unit 124, the image processing unit 120, a display control unit 121, the printing-data generating unit 122, and the print-job generating unit 123. Out of these units, the input control unit 124 and the display control unit 121 are realized by the CPU of the control unit 15 reading out an operating system program stored in the ROM, untaring the operating system program into the RAM, and executing the operating system program. The image processing unit 120, the printing-data generating unit 122, and the print-job generating unit 123 are realized by the CPU of the control unit 15 reading out the above-described image processing application program stored in the ROM, untaring the image processing application into the RAM, and executing the image processing application. Here, the printing-data generating unit 122 is provided, for example, as a plug-in feature installed in the image processing application. Incidentally, at least some of these units can be realized by a dedicated hardware circuit (for example, a semiconductor integrated circuit or the like).

The input control unit 124 receives various inputs from the input unit 13, and controls the inputs. For example, the user can input image designation information designating an image to be given a surface effect out of images (for example, a photo image, a text image, a graphic image, and a synthetic image of these, etc.) stored in the storage unit 12, i.e., image data for chromatic printing (hereinafter, may be referred to as a "target image") by operating the input unit 13. Incidentally, a method to input the image designation information is not limited to this, and any methods can be used.

The display control unit 121 controls the display of information on the display unit 14. In the present embodiment, when the input control unit 124 has received image designation information, the display control unit 121 reads out an image specified in the image designation information from the storage unit 12, and controls the display unit 14 to display the read image on the screen thereof.

The user operates the input unit 13 while checking a target image displayed on the display unit 14, thereby can input designation information designating an area to be given a surface effect and a type of the surface effect. Incidentally, a method to input the designation information is not limited to this, and any methods can be used.

Figure 7:
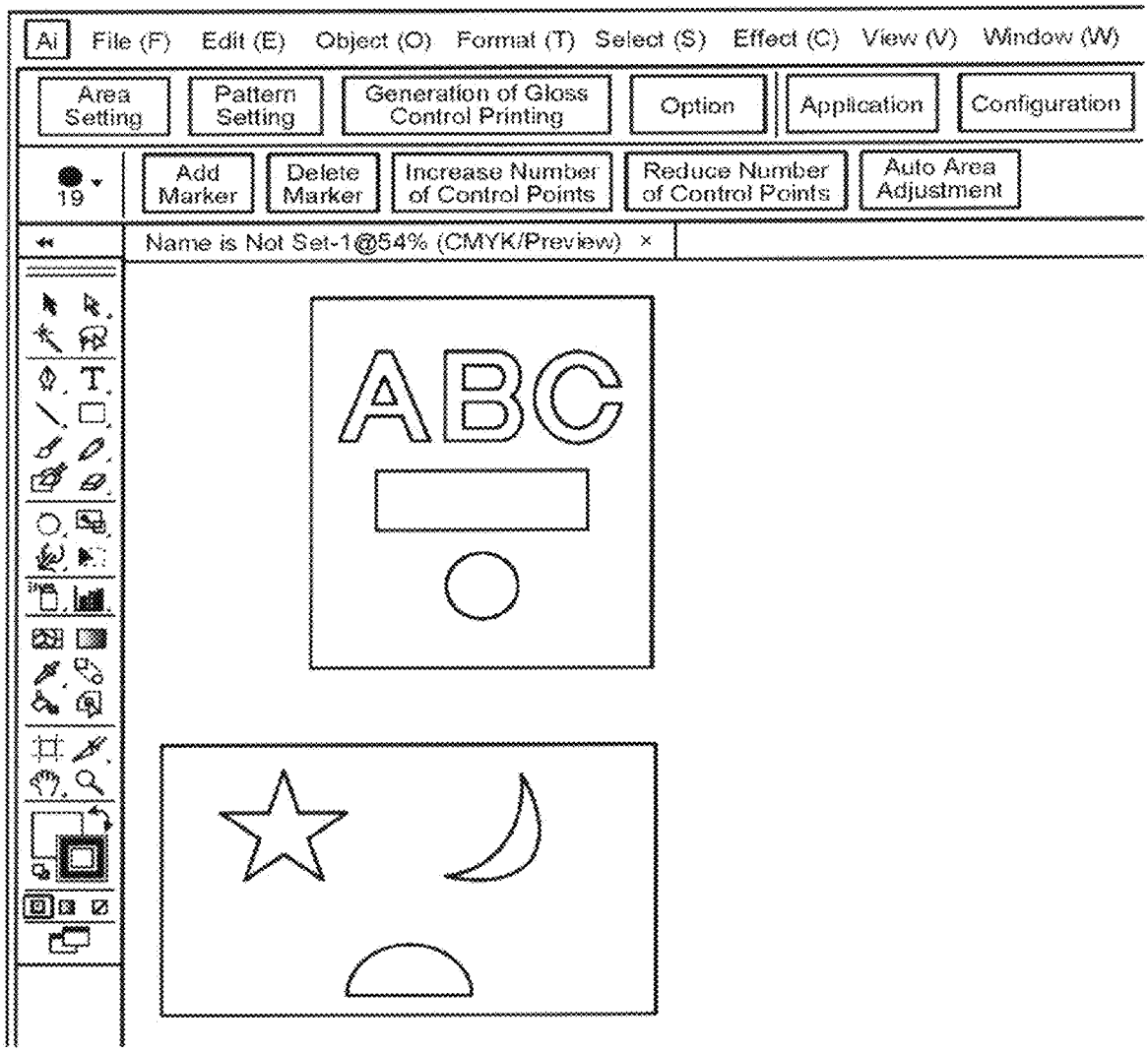
FIG. 7 is a diagram showing an example of a screen displayed by an image processing application.
Figure 8:
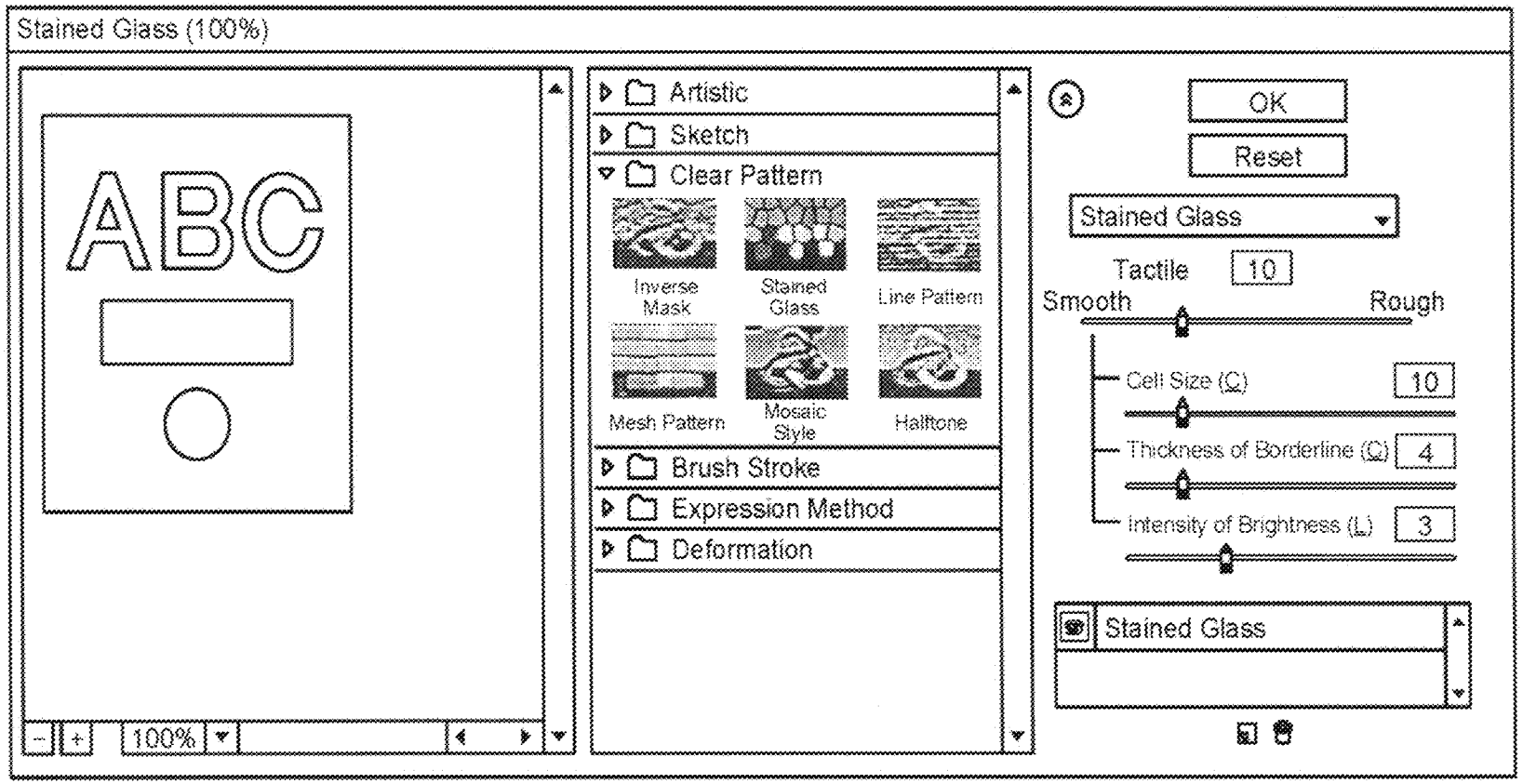
FIG. 8 is a diagram showing an example of a screen displayed by the image processing application.

More specifically, the display control unit 121 causes the display unit 14 to display thereon, for example, a screen shown in FIG. 7. FIG. 7 shows an example of a screen displayed when plug-in has been installed in Illustrator sold by Adobe Systems, Inc. On the screen shown in FIG. 7, an image represented by target image data (image data for chromatic printing), which is an object to be processed, is displayed, and the user presses an Add Marker button through the input unit 13 and inputs an operation to specify an area to which the user wants to give a surface effect, thereby the area to be given the surface effect is specified. The user performs such an operation input with respect to all areas to be given surface effects. Then, the display control unit 121 of the host device 10 displays, for example, a screen shown in FIG. 8 with respect to each area specified on the display unit 14. On the screen shown in FIG. 8, an image of an area specified as an area to be given a surface effect is displayed, and the user inputs an operation to specify a type of surface effect to be given to the image through the input unit 13, thereby the type of surface effect to be given to the area is specified. As types of surface effects, specular gloss and solid gloss in FIG. 3 are described as "inverse mask" in FIG. 8, and the other effects other than specular gloss and solid gloss in FIG. 3 are described as stained glass, line pattern, mesh pattern, mosaic style, halftone matt, and halftone in FIG. 8; it shows that each of the surface effects can be specified.

To return to FIG. 6, the image processing unit 120 performs image processing on a target image on the basis of an instruction from the user through the input unit 13.

The printing-data generating unit 122 generates chromatic printing data, gloss control printing data, and image data for clear toner printing. That is, when the input control unit 124 has received a color designation by the user with respect to a drawing object of a target image, the printing-data generating unit 122 generates image data for chromatic printing in accordance with the color designation.

Furthermore, when the input control unit 124 has received designations of a transparent image, such as a watermark or a texture, other than surface effects and an area to be given the transparent image, the printing-data generating unit 122 generates clear toner printing data for identifying the transparent image and an area of a transfer sheet to be given the transparent image in accordance with the designations by the user.

Moreover, when the input control unit 124 has received designation information an area to be given a surface effect and a type of the surface effect), the printing-data generating unit 122 generates gloss control printing data capable of identifying an area of a transfer sheet to be given the surface effect and the type of the surface effect on the basis of the designation information. Here, the printing-data generating unit 122 generates gloss control printing data that specifies an area to be given a surface effect indicated by a gloss control value in units of a drawing object of image data of a target image.

Figures 9, 10:
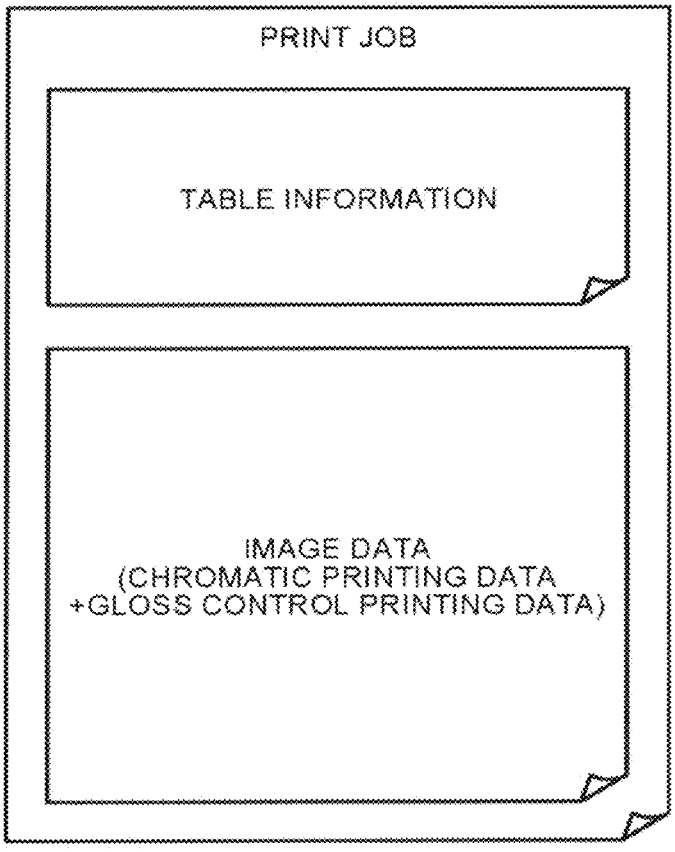
FIG. 9 is a diagram schematically showing a surface-effect selection table.
FIG. 10 is a schematic diagram conceptually showing a configuration example of a print job.

The previously-registered surface-effect selection table is stored in the storage unit 12. Although detailed contents of the surface-effect selection table will be described later, the surface-effect selection table is information indicating a correspondence relation between a type of surface effect and a density value (an example of density information). FIG. 9 is a diagram schematically showing the surface-effect selection table. Concrete contents of the surface-effect selection table will be described later. In an example of FIG. 9, a density value of gloss control printing corresponding to an area where "PG" (specular gloss) is specified by the user is "98%", a density value of gloss control printing corresponding to an area were "G" (solid gloss) is specified is "90%", a density value of gloss control printing corresponding to an area where "M" (halftone matt) is specified is "16%", and a density value of gloss control printing corresponding to an area where "PM" (matt) is specified is "6%".

Alternatively, the surface-effect selection table can be stored in, for example, a storage server (a cloud) on a network such as the Internet, and the control unit 15 can be configured to acquire the surface-effect selection table from the server and store the acquired surface-effect selection table in the storage unit 12. Furthermore, several types of previously-registered surface-effect selection tables can be stored in the storage unit 12.

In this example, data composing the surface-effect selection table is made up of a common part independent of a type (a model) of the printer device 70 and a non-common part other than the common part, and the non-common part is set so as to differ by surface-effect selection table.

To return to FIG. 6, the printing-data generating unit 122 sets a density value (a gloss control value) of a drawing object for which a given surface effect has been specified by the user to a value according to a type of the surface effect while referring to the surface-effect selection table shown in FIG. 9, thereby generating gloss control printing data. For example, assume that the user has specified to give "PG" to an area where "ABC" is displayed out of a target image of the chromatic printing data shown in FIG. 2, "G" to an area of a rectangle, and "M" to an area of a circle. In this case, the printing-data generating unit 122 sets a density value of the drawing object ("ABC") for which "PG" has been specified by the user to "98%", a density value of the drawing object ("rectangle") for which "G" has been specified to "90%", and a density value of the drawing object ("circle") for which "M" has been specified to "16%", thereby generating gloss control printing data. The gloss control printing data generated by the printing-data generating unit 122 is a vector form of data expressed as a set of coordinates of points, parameters of equations expressing lines or planes connecting the points, and drawing objects indicating filling and special effects, etc. FIG. 4 is a diagram representing this gloss control printing data in an image. The printing-data generating unit 122 integrates the image data of the target image (the image data for chromatic printing) and image data for clear toner printing, thereby generating document data, and passes the generated document data to the print-job generating unit 123. Incidentally, in the following description, a case where image data for clear toner printing is not generated is taken as an example.

The print-job generating unit 123 generates a print job on the basis of document data. The print job in the present embodiment is composed of chromatic printing data, gloss control printing data, a job command that specifies, for example, the setting of a printer, the setting of aggregation, and the setting of duplexing, etc. with respect to the printer, and table information capable of identifying a surface-effect selection table used in generation of the gloss control printing data. In this example, the table information indicates a non-common part of the surface-effect selection table; however, the table information is not limited to this, and can be, for example, information indicating the whole surface-effect selection table. FIG. 10 is a schematic diagram conceptually showing a configuration example of the print job. In the example of FIG. 10, illustration of the job command is omitted. Incidentally, when it is known in advance that the surface-effect selection table used in generation of the gloss control printing data coincides with a surface-effect selection table that a DFE to which the print job is to be transmitted has, the table information does not have to be included in the print job.

Figure 11:
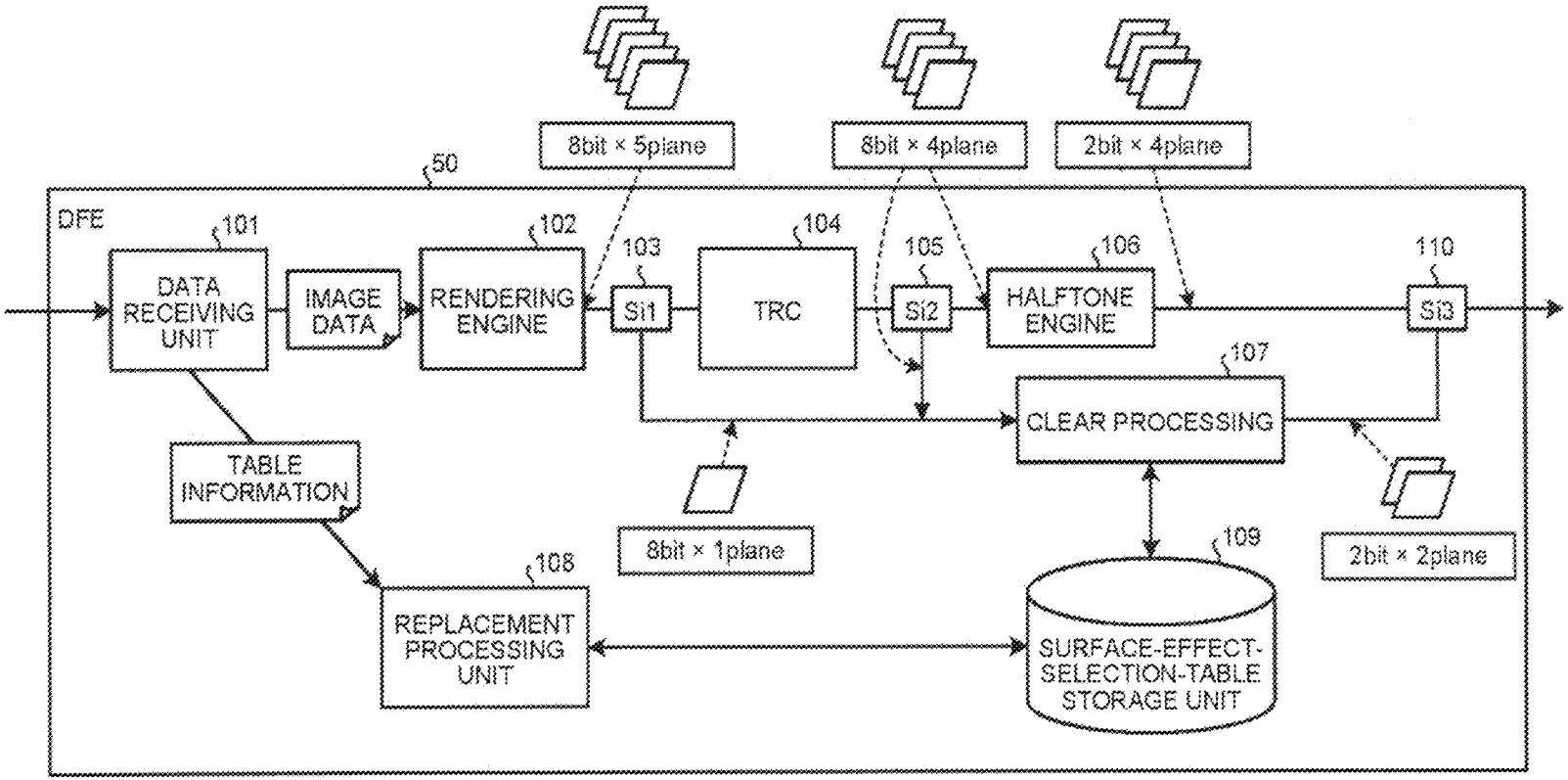
FIG. 11 is a diagram showing a functional configuration example of a DFE.

Subsequently, a functional configuration of the DFE 50 is explained. As shown in FIG. 11, the DFE 50 includes a data receiving unit 101, a rendering engine 102, an si1 unit 103, a tone reproduction curve (TRC) 104, an si2 unit 105, a halftone engine 106, a clear processing 107, a replacement processing unit 108, a surface-effect-selection-table storage unit 109, and an si3 unit 110.

The data receiving unit 101 receives a print job from the host device 10. The data receiving unit 101 outputs image data (chromatic printing data and gloss control printing data) included in the print job to the rendering engine 102, and outputs table information included in the print job to the replacement processing unit 108. In this example, the data receiving unit 101 can be regarded to correspond to a "receiving unit" in claims.

The image data included in the print job received by the data receiving unit 101 is input to the rendering engine 102. The rendering engine 102 linguistically interprets the input image data, and converts the image data represented in a vector form into a raster form and also converts the image data represented in an RGB color space into a CMYK color space, and then outputs respective 8-bit image data for C, M, Y, and K-color printings (chromatic printing data) and 8-bit gloss control printing data. The si1 unit 103 outputs the chromatic printing data to the TRC 104, and outputs the gloss control printing data to the clear processing 107.

The chromatic printing data is input to the TRC 104 through the si1 unit 103. The TRC 104 performs gamma correction on the input chromatic printing data by using gamma curves of a 1D_LUT generated by calibration. Image processing includes total toner amount control, etc. besides the gamma correction; however, in the example in this embodiment, description of the other image processing is omitted. The si2 unit 105 outputs the gamma-corrected chromatic printing data corrected by the TRC 104 to the clear processing 107 as data for generating an inverse mask. The gamma-corrected chromatic printing data is input to the halftone engine 106 through the si2 unit 105. The halftone engine 106 performs a halftone process of converting the input chromatic printing data into, for example, 2-bit CMYK image data to output the chromatic printing data to the printer device 70, and outputs the halftone-processed chromatic printing data. Incidentally, the conversion into 2-bit data is just an example, and it is not limited to this.

The table information included in the print job received by the data receiving unit 101 is input to the replacement processing unit 108. The replacement processing unit 108 replaces a part or whole of the surface-effect selection table implemented in the DFE 50 in advance on the basis of the input table information. Although detailed contents will be described later, the surface-effect selection table shows a correspondence relation between a type of surface effect and a density value. As described above, a surface-effect selection table in the present embodiment is made up of a common part independent of a type of the printer device 70 and a non-common part other than the common part, and the table information included in the print job indicates a non-common part of the surface-effect selection table used in creation of the gloss control printing data included in the print job. In this example, the replacement processing unit 108 can be regarded to correspond to a "replacing unit" in claims.

The surface-effect-selection-table storage unit 109 stores therein the surface-effect selection table implemented in the DFE 50 in advance (in the following description, may be referred to as the "default surface-effect selection table"), and, when a non-common part of the default surface-effect selection table is different from a non-common part indicated by the input table information, the replacement processing unit 108 replaces the non-common part of the default surface-effect selection table by the non-common part indicated by the input table information, thereby generating a surface-effect selection table for the print job. Then, the surface-effect selection table for the print job is stored in the surface-effect-selection-table storage unit 109 separately from the default surface-effect selection table.

The 8-bit gloss control printing data converted by the rendering engine 102 is input to the clear processing 107 through the si1 unit 103, and the 8-bit gamma-corrected chromatic printing data corrected by the TRC 104 is input to the clear processing 107 through the si2 unit 105. Using the input gloss control printing data, the clear processing 107 determines a surface effect with respect to a density value pixel value) of each of pixels composing the gloss control printing data with reference to the surface-effect selection table stored in the surface-effect-selection-table storage unit 109, and decides to turn the glosser 80 on or off and arbitrarily generates an inverse mask or a solid mask using the input chromatic printing data according to the determination, thereby arbitrarily generating 2-bit image data for clear toner printing (in the following description, may be referred to as the "clear-toner printing data") for attaching clear toner. Then, according to a result of the determination of the surface effect, the clear processing 107 arbitrarily generates clear-toner printing data used in the printer device 70 and clear-toner printing data used in the low-temperature fixing device 90 and outputs the generated clear-toner printing data, and outputs on/off information indicating on or off of the glosser 80.

The inverse mask here is for equalizing a total amount of attached CMYK and clear toners on pixels composing a target area to be given the surface effect. Specifically, image data obtained by adding up all density values of the pixels composing the target area in image data for CMYK printing and deducting the sum of the values from a given value is the inverse mask. For example, the above-described inverse mask 1 is represented by the following equation (1).

$$\mathrm{Clr}=100-(C+M+Y+K);\ \text{however, if } \mathrm{Clr}<0,\ \mathrm{Clr}=0 \tag{1}$$

In the equation (1), Clr, C, M, Y, and K denote density rates of clear, C, M, Y, and K toners converted from respective density values in each pixel, respectively. That is, according to the equation (1), a total attached toner amount of a total amount of attached C, M, Y, and K toners plus an amount of attached clear toner on all pixels composing the target area to be given the surface effect is controlled to be 100%. Incidentally, when a total amount of attached C, M, Y, and K toners is 100% or more, clear toner is not attached, and a density rate of clear toner is set to 0%. This is because a part where a total amount of attached C, M, Y, and K toners exceeds 100% is smoothed by a fixing process. By controlling the total attached toner amount on all pixels composing the target area to be given the surface effect to be 100% or more in this way, the irregularity of the surface due to differences in total attached toner amount in the target area is eliminated, and as a result, an image has gloss caused by specular reflection of light. However, there are inverse masks found by other than the equation (1), and several types of inverse masks are conceivable.

For example, the inverse mask can be the one for uniformly attaching clear toner to pixels. The inverse mask in this case is also called a solid mask, and is represented by the following equation (2).

$$\mathrm{Clr}=100 \tag{2}$$

Incidentally, some of the target pixels to be given the surface effect can be associated with a density rate other than 100%, and several patterns of solid masks are conceivable.

Furthermore, for example, the inverse mask can be the one found by multiplication of respective color-by-color background exposure rates. The inverse mask in this case is represented by, for example, the following equation (3).

$$\mathrm{Clr}=100\times\{(100-C)/100\}\times\{(100-M)/100\}\times\{(100-Y)/100\}\times\{(100-K)/100\} \tag{3}$$

In the above equation (3), (100−C)/100 denotes a C background exposure rate, (100−M)/100 denotes an M background exposure rate, (100−Y)/100 denotes a Y background exposure rate, and (100−K)/100 denotes a K background exposure rate.

Moreover, for example, the inverse mask can be the one found by a method assuming that halftone dots corresponding to the maximum area ratio regulates the smoothness. The inverse mask in this case is represented by, for example, the following equation (4).

$$\mathrm{Clr}=100-\max(C, M, Y, K) \tag{4}$$

In the above equation (4), max(C, M, Y, K) denotes that a density value of color showing the maximum density value out of YMCK is a representative value.

In short, the inverse mask can be the one represented by any of the above equations (1) to (4).

Subsequently, concrete contents of the surface-effect selection table are explained. The surface-effect selection table in the present embodiment is a table showing a correspondence relation between a density value as a gloss control value indicating a surface effect and a type of the surface effect and a correspondence relation between image data for clear toner printing used in the printer device 70 and image data for clear toner printing used in a post-processing apparatus. A configuration of the image forming system can vary; however, in the present embodiment, it is configured that the glosser 80 and the low-temperature fixing device 90 as post-processing apparatuses are connected to the printer device 70. Therefore, control information relating to the post-processing apparatuses according to the configuration of the image forming system is that on/off information indicating on or off of the glosser 80. Furthermore, the clear-toner printing data used in a post-processing apparatus includes clear-toner printing data used in the low-temperature fixing device 90.

FIG. 12 is a diagram showing an example of a data configuration of the surface-effect selection table. Incidentally, the surface-effect selection table can be configured to show control information relating to a post-processing apparatus, image data for clear toner printing used in the printer device 70 (hereinafter, referred to as "clear-toner printing data 1") and image data for clear toner printing used in the post-processing apparatus (hereinafter, referred to as "clear-toner printing data 2"), and a correspondence relation between density value and type of surface effect with respect to each of configurations of different image forming systems; however, in FIG. 12, a data configuration for the image forming system according to the present embodiment is illustrated. In a correspondence relation between type of surface effect and density value shown in FIG. 12, types of surface effects are associated with ranges of density values, respectively. Furthermore, the types of surface effects are associated with rates of density (density rates) converted from respective representative values in the ranges of density values in units of 2%, respectively. Specifically, a surface effect of glossing (a specular gloss and a solid gloss) is associated with a range of density values ("212" to "255") with a density rate of 84% or more, and a surface effect of suppressing the gloss (halftone matt and matt) is associated with a range of density values ("1" to "43") with a density rate of 16% or less. Furthermore, a surface effect, such as a texture and a woven pattern watermark, is associated with a range of density values with a density rate of 20% to 80%.

More specifically, for example, as a surface effect, specular gloss (PM: Premium Gloss) is associated with pixel values of "238" to "255"; further, different types of specular gloss are associated with three ranges of the pixel values: a range of pixel values "238" to "242", a range of pixel values "243" to "247", and a range of pixel values "248" to "255", respectively. Furthermore, solid gloss (G: Gloss) is associated with pixel values of "212" to "232"; further, different types of solid gloss are associated with four ranges of the pixel values: a range of pixel values "212" to "216", a range of pixel values "217" to "221", a range of pixel values "222" to "227", and a range of pixel values "228" to "232", respectively. Moreover, halftone matt (M: Matt) is associated with pixel values of "23" to "43"; further, different types of halftone matt are associated with four ranges of the pixel values: a range of pixel values "23" to "28", a range of pixel values "29" to "33", a range of pixel values "34" to "38", and a range of pixel values "39" to "43", respectively. Furthermore, matt (PM: Premium Matt) is associated with pixel values of "1" to "17"; further, different types of matt are associated with three ranges of the pixel values: a range of pixel values "1" to "7", a range of pixel values "8" to "12", and a range of pixel values "13" to "17", respectively. According to such different types of the same surface effect, an equation used to find image data for clear toner printing used in the printer device 70 and the low-temperature fixing device 90 is different, but the operations of the printer main body and the post-processing apparatus are the same. Incidentally, no surface effect is associated with a density value "0".

Furthermore, FIG. 12 shows on/off information indicating on or off of the glosser 80 and contents of clear-toner printing data 1 ("Clr-1" in FIG. 1) used in the printer device 70 and clear-toner printing data 2 ("Clr-2" in FIG. 1) used in the low-temperature fixing device 90 in a manner corresponding to a pixel value and a surface effect. For example, when a surface effect is specular gloss, it shows that the glosser 80 is turned on, clear-toner printing data 1 used in the printer device 70 indicates inverse mask, and clear-toner printing data 2 used in the low-temperature fixing device 90 indicates no data. The inverse mask is found, for example, by the above-described equation (1).

Furthermore, when a density value is in a range of "228" to "232" and a surface effect is solid gloss, it shows that the glosser 80 is turned off, clear-toner printing data 1 used in the printer device 70 indicates inverse mask 1, and clear-toner printing data 2 used in the low-temperature fixing device 90 indicates no data. Incidentally, the inverse mask 1 can be the one represented by any of the above-described equations (1) to (4). This is because the glosser 80 is turned off, so a total amount of attached toners to be smoothed differs, and therefore the irregularity of the surface is increased due to specular gloss, and as a result, solid gloss with a lower gloss level is obtained by the specular gloss. Moreover, when a surface effect halftone matt, it shows that the glosser 80 is turned off, clear-toner printing data 1 used in the printer device 70 indicates halftone, and clear-toner printing data 2 used in the low-temperature fixing device 90 indicates no data. Furthermore, when a surface effect is matt, it shows that the glosser 80 can be turned either on or off, clear-toner printing data 1 used in the printer device 70 indicates no data, and clear-toner printing data 2 used in the low-temperature fixing device 90 indicates solid mask. The solid mask is found, for example, by the above-described equation (2).

With reference to the above-described surface-effect selection table, the clear processing 107 determines a surface effect associated with each pixel value indicated by gloss control printing data, and determines whether the glosser 80 is turned on or off, and determines what kind of clear-toner printing data is used in the printer device 70 and the low-temperature fixing device 90. Incidentally, the clear processing 107 determines whether the glosser 80 is turned on or off on a page-by-page basis. Then, as described above, according to a result of the determination, the clear processing 107 arbitrarily generates clear-toner printing data and outputs the generated clear-toner printing data, and outputs on/off information indicating on or off of the glosser 80.

When a surface-effect selection table for a print job has been stored in the surface-effect-selection-table storage unit 109, the clear processing 107 in the present embodiment creates clear-toner printing data with reference to the surface-effect selection table for the print job, and then deletes (discards) the surface-effect selection table for the print job from the surface-effect-selection-table storage unit 109. On the other hand, when only the default surface-effect selection table has been stored in the surface-effect-selection-table storage unit 109, the clear processing 107 creates clear-toner printing data with reference to the default surface-effect selection table.

Here, assume, for example, that a DFE including the surface-effect selection table shown in FIG. 12 is a system A, and a DFE including a surface-effect selection table shown in FIG. 13 is a system B. In this example, parts surrounded with thick-bordered boxes in FIG. 13 are non-common parts; however, this is just an example. For example, when it is assumed that the host device 10 has generated gloss control printing data on the basis of the surface-effect selection table shown in FIG. 12 ("the surface-effect selection table for the system A") and transmitted a print job including the generated gloss control printing data to the system B, the system B refers to the surface-effect selection table shown in FIG. 13 ("the surface-effect selection table for the system B") and determines a surface effect associated with each pixel value indicated by the gloss control printing data input from the host device 10, and generates clear-toner printing data according to a result of the determination; however, a print result based on this clear-toner printing data is different from an expected value Specifically, with respect to the gloss control printing data input from the host device 10 (the gloss control printing data created on the basis of the surface-effect selection table for the system A), even when a density value "112" has been specified to designate watermark text 3 (internal use only), the density value is interpreted as watermark text 6 (strictly confidential) in the surface-effect selection table for the system B. Furthermore, when the system B has improved in gradation expression capacity and becomes able to represent six levels of solid gloss more than four levels that the system A can represent, it is conceivable that the stepwise increment in density is adjusted, for example, as shown in FIG. 13, thereby making the table capable of representing more tones. In such a situation, with respect to the gloss control printing data input from the host device 10 (the gloss control printing data created on the basis of the surface-effect selection table for the system A), even when a density value "212" has been specified in expectation of solid gloss type 4, the density value is interpreted as solid gloss type 6 in the surface-effect selection table for the system B.

To prevent the host device 10 from producing a different print result from a print result expected by the host device 10 side as described above due to a difference between a surface-effect selection table used by the host device 10 to create gloss control printing data and a surface-effect selection table included in a DFE to which a print job including the gloss control printing data is transmitted, in the present embodiment, the host device 10 transmits a print job including table information capable of identifying a surface-effect selection table used in generation of gloss control printing data (in this example, information indicating the non-common parts of the surface-effect selection table used in generation of the gloss control printing data) to the DFE 50. Then, when having received the print job, the DFE 50 replaces the default surface-effect selection table by the most suitable surface-effect selection table for the print job on the basis of the table information included in the print job.

To return to FIG. 11 again, continue the explanation. The si3 unit 110 integrates the halftone-processed 2-bit CMYK image data (chromatic printing data) and the 2-bit clear-toner printing data generated by the clear processing 107, and outputs the integrated image data to the MIC 60. Incidentally, the clear processing 107 may not generate at least either clear-toner printing data 1 used in the printer device 70 or clear-toner printing data 2 used in the low-temperature fixing device 90, so the clear-toner printing data generated by the clear processing 107 is integrated with the 2-bit CMYK image data by the si3 unit 110; when the clear processing 107 has not generated both of clear-toner printing data, the 2-bit CMYK image data are output from the si3 unit 110. As a result, four to six sets of 2-bit image data are sent from the DFE 50 to the MIC 60. Furthermore, the si3 unit 110 also outputs the on/off information of the glosser 80 output from the clear processing 107 to the MIC 60.

Figure 14:
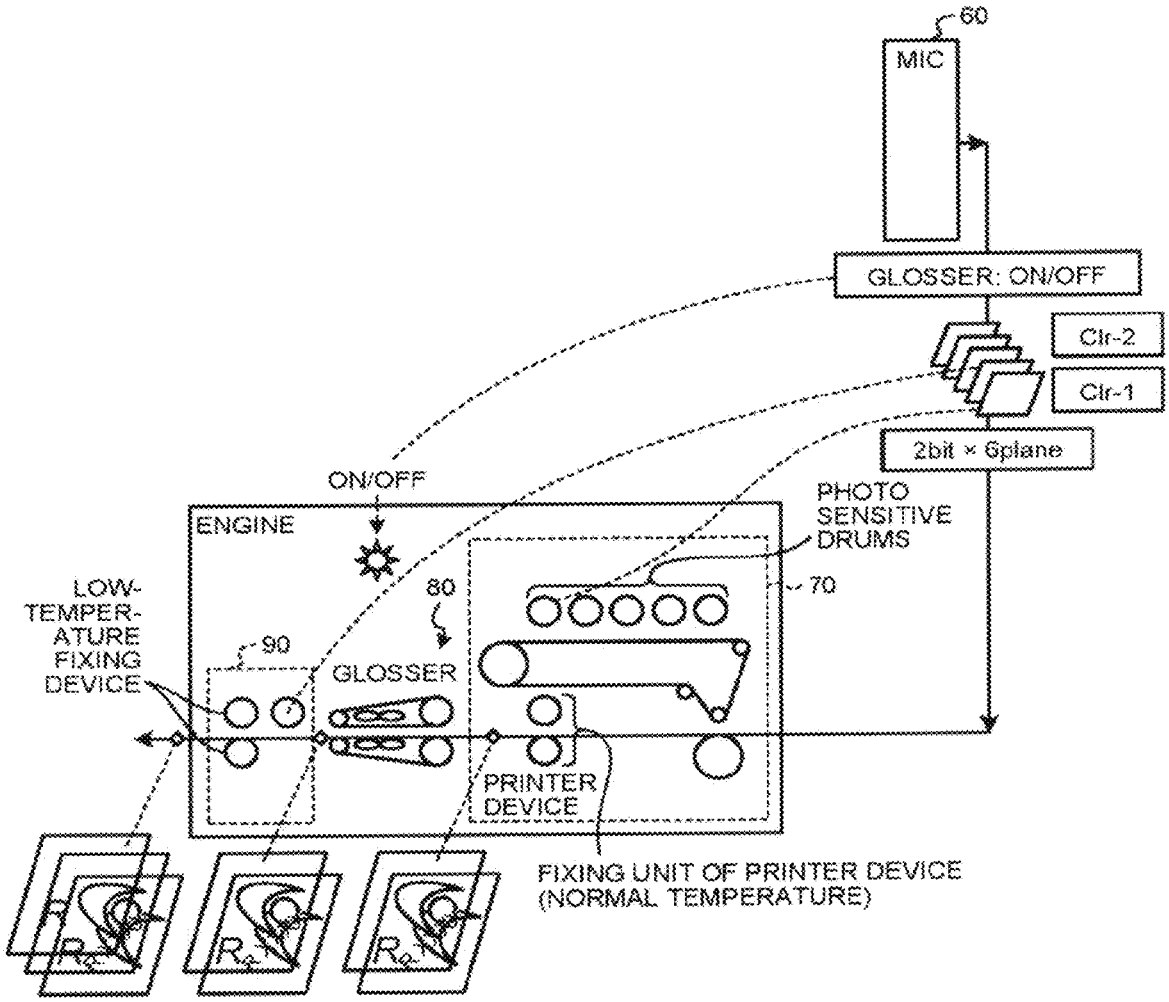
FIG. 14 is a diagram showing how an MIC allocates image data.

The MIC 60 is connected to the DFE 50 and the printer device 70, and receives chromatic printing data and clear-toner printing data from the DFE 50 and allocates the received image data to corresponding devices, and controls a post-processing apparatus. More specifically, as shown in FIG. 14, the MIC 60 outputs the image data for C, M, Y, and K-color printing (chromatic printing data) out of the image data output from the DEE 50 to the printer device 70, and, if there is clear-toner printing data 1 (Clr-1) used in the printer device 70, also outputs the clear-toner printing data 1 to the printer device 70, and turns the glosser 80 on or off on the basis of on/off information output from the DFE 50, and, if there is clear-toner printing data 2 (Clr-2) used in the low-temperature fixing device 90, outputs the clear-toner printing data 2 to the low-temperature fixing device 90. The glosser 80 can switch between a path for performing fixing and a path for not performing fixing according to the on/off information. The low-temperature fixing device 90 can perform on/off switching and the same path switching as the glosser 80 depending on the presence or absence of clear-toner printing data 2.

Figure 15:
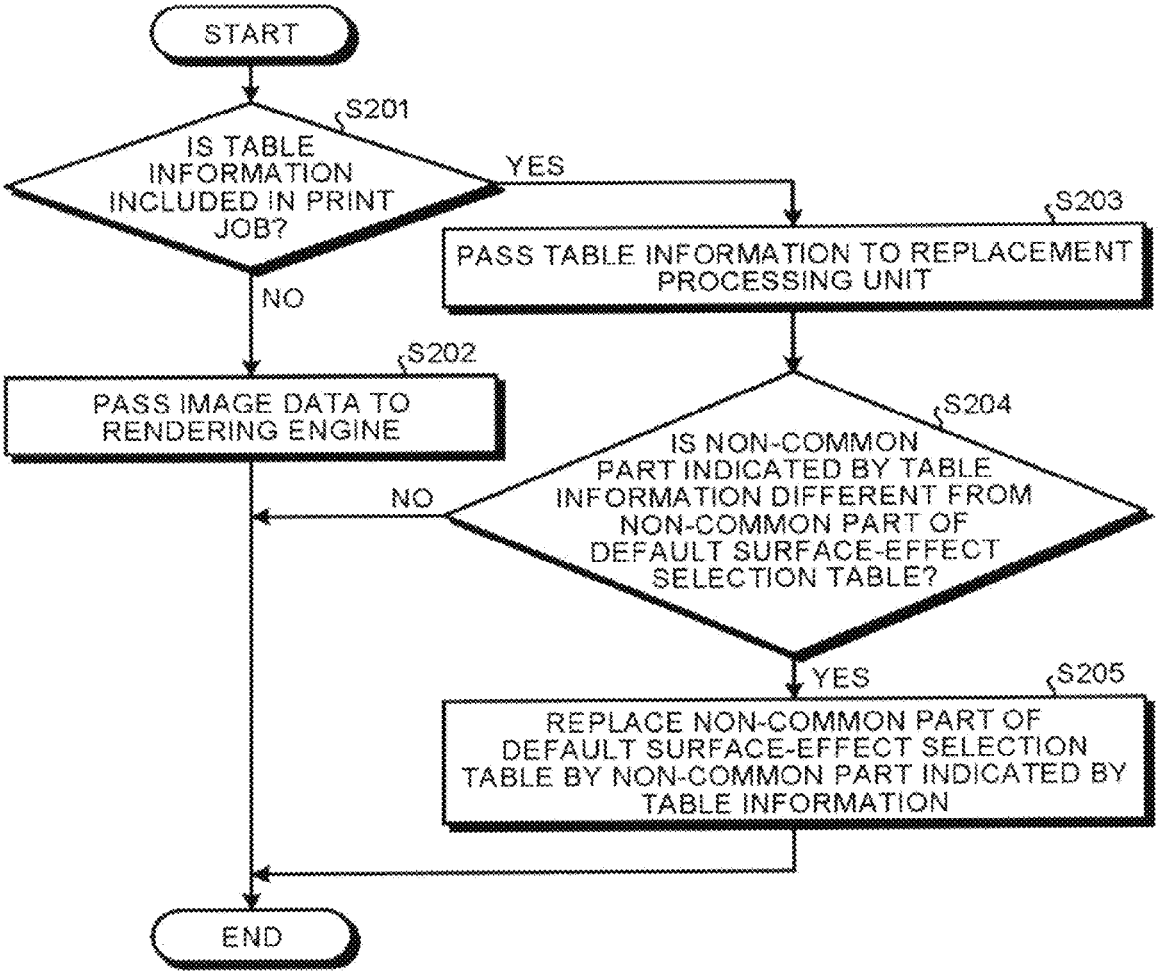
FIG. 15 is a flowchart showing an example of operation of the DFE.

Subsequently, how the DFE 50 replaces a non-common part of the default surface-effect selection table according to a print job from the host device 10 is explained with reference to FIG. 15. As shown in FIG. 15, the data receiving unit 101 determines whether table information is included in the print job (Step S201). When table information is not included in the print job (NO at Step S201), the data receiving unit 101 passes image data (chromatic printing data and gloss control printing data) included in the print job to the rendering engine 102 (Step S202).

On the other hand, when table information is included in the print job (YES at Step S201), the data receiving unit 101 passes the table information to the replacement processing unit 108 (Step S203). Then, the replacement processing unit 108 determines whether a non-common part indicated by the input table information is different from a non-common part of the default surface-effect selection table (the surface-effect selection table implemented in the DFE 50 in advance) (Step S204). When having determined that a non-common part indicated by the input table information is different from a non-common part of the default surface-effect selection table (YES at Step S204), the replacement processing unit 108 replaces the non-common part of the default surface-effect selection table by the non-common part indicated by the input table information (Step S205).

Incidentally, in the above embodiment, table information is described as information indicating a non-common part of a surface-effect selection table as an example; however, table information is not limited to this, and, for example, table information can be information indicating a whole surface-effect selection table. In this case, when a surface-effect selection table indicated by the table information is different from the surface-effect selection table implemented in the DFE 50 in advance, the replacement processing unit 108 replaces the surface-effect selection table implemented in the DFE 50 in advance by the surface-effect selection table indicated by the table information.

In short, the DFE 50 just has to be configured to include a receiving unit and a replacing unit. The receiving unit receives a print job, which includes gloss control printing data indicating a type of surface effect by predetermined density information and table information capable of identifying a surface-effect selection table used in creation of the gloss control printing data, from the host device 10. The replacing unit replaces a part or whole of a surface-effect selection table implemented in the DFE 50 in advance (corresponding to the default surface-effect selection table) on the basis of the table information included in the print job.

As described above, in the present embodiment, the host device 10 transmits a print job including table information capable of identifying a surface-effect selection table used in generation of gloss control printing data (in this example, information indicating a non-common part of a surface-effect selection table used in generation of gloss control printing data) to the DFE 50. Then, when having received the print job, the DFE 50 replaces the default surface-effect selection table by the most suitable surface-effect selection table for the print job on the basis of the table information included in the print job; therefore, it is possible to achieve a beneficial effect of obtaining the same level of print result as an expected print result.

Second Embodiment

In an image forming system according to a second embodiment, part of the function of a DFE is implemented in a server device on a network.

Figure 16:
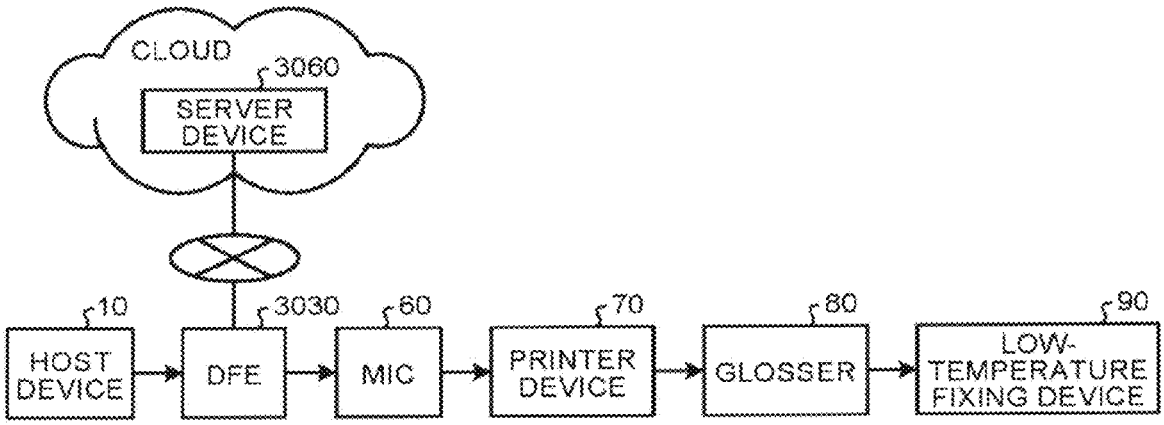
FIG. 16 is a diagram showing an example of a configuration of an image forming system according to a second embodiment.

FIG. 16 is a diagram showing an example of a configuration of the image forming system according to the present embodiment. As shown in FIG. 16, the image forming system according to the present embodiment includes the host device 10, a DFE 3030, the MIC 60, the printer device 70, the glosser 80, and the low-temperature fixing device 90.

In the present embodiment, the DFE 3030 is connected to a server device 3060 via a network such as the Internet. Furthermore, in the present embodiment, the functions of the replacement processing unit 108 and the clear processing 107 of the DFE 50 in the first embodiment are provided to the server device 3060.

That is, specifically, in the present embodiment, the DEE 3030 is connected to the single server device 3060 via a network (a cloud) such as the Internet, and the server device 3060 is equipped with the functions of the replacement processing unit 108 and the clear processing 107 of the DFE 50 in the first embodiment and is configured to generate clear-toner printing data.

Figure 17:
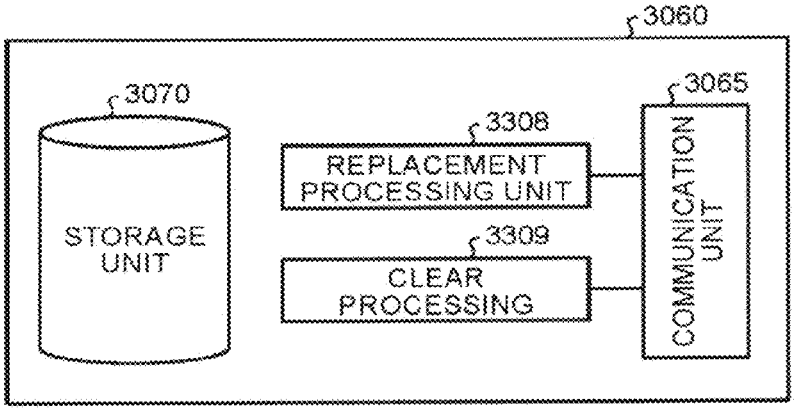
FIG. 17 is a diagram showing a functional configuration example of a server device according to the second embodiment.

First, the server device 3060 is explained. FIG. 17 is a block diagram showing a functional configuration of the server device 3060 according to the present embodiment. The server device 3060 is mainly includes a storage unit 3070, a replacement processing unit 3308, a clear processing 3309, and a communication unit 3065.

The storage unit 3070 is a storage medium, such as an HDD or a memory. The storage unit 3070 includes the surface-effect-selection-table storage unit 109 in the first embodiment. The communication unit 3065 transmits/receives various data and requests to/from the DFE 3030. More specifically, the communication unit 3065 receives information, such as the chromatic printing data, gloss control printing data, and table information input to the replacement processing unit 108 and the clear processing 107 in the first embodiment, from the DFE 3030. Furthermore, the communication unit 3065 transmits clear-toner printing data generated by the clear processing 3309 to the DFE 3030.

Incidentally, the function of the replacement processing unit 3308 is the same as the function of the replacement processing unit 108 in the first embodiment, and the function of the clear processing 3309 is the same as the function of the clear processing 107 in the first embodiment.

Figure 18:
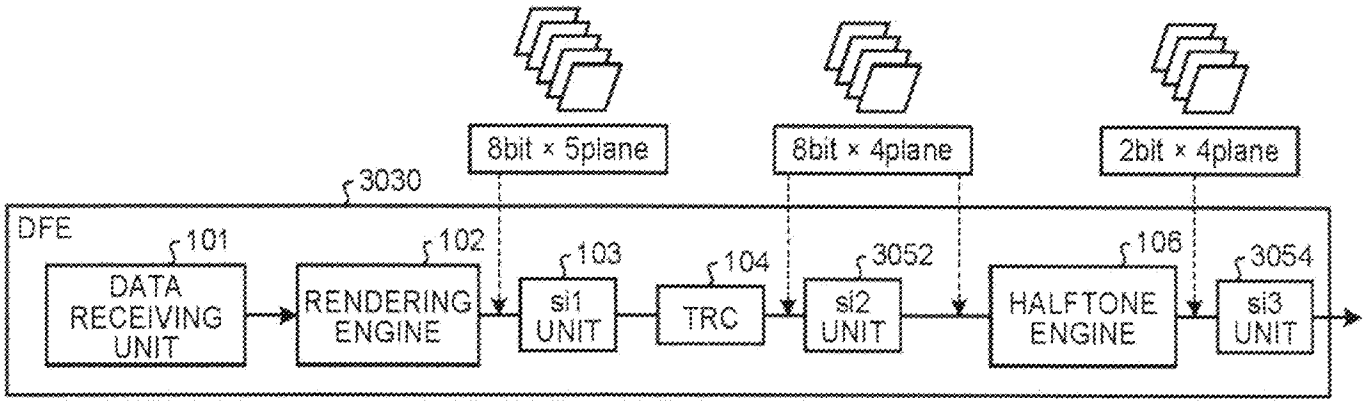
FIG. 18 is a diagram showing a functional configuration example of a DFE according to the second embodiment.

Subsequently, the DFE 3030 is explained. FIG. 18 is a block diagram showing an example of a functional configuration of the DFE 3030 according to the second embodiment. The DFE 3030 according to the present embodiment mainly includes the data receiving unit 101, the rendering engine 102, the si1 unit 103, the TRC 104, an si2 unit 3052, the halftone engine 106, and an si3 unit 3054. Here, the functions and configurations of the data receiving unit 101, the rendering engine 102, the si1 unit 103, the TRC 104, and the halftone engine 106 are the same as those of the DFE 50 in the first embodiment.

The si2 unit 3052 in the present embodiment transmits table information included in a print job received by the data receiving unit 101, 8-bit gloss control printing data converted by the rendering engine 102, gamma-corrected 8-bit CMYK image data (chromatic printing data) corrected by the TRC 104, and a request to generate a clear-toner printing to the server device 3060. The si3 unit 3054 receives clear-toner printing data from the server device 3060.

Figure 19:
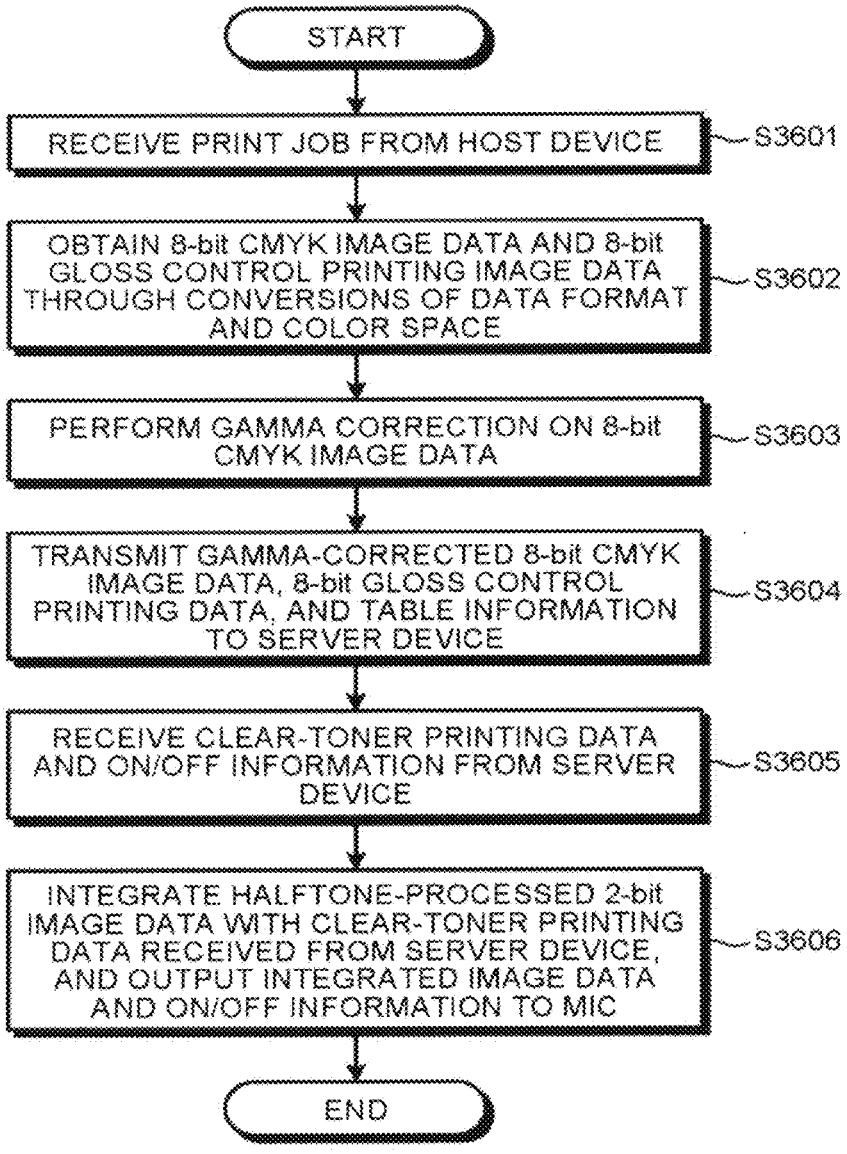
FIG. 19 is a flowchart showing an example of operation of the DFE according to the second embodiment.

FIG. 19 is a flowchart showing an example of operation of the DFE 3030 according to the present embodiment. As shown in FIG. 19, when the data receiving unit 101 has received a print job from the host device 10 (Step S3601), the rendering engine 102 linguistically interprets the print job, and converts image data represented in a vector form into a raster form and also converts the image data represented in an RGB color space into a CMYK color space, thereby obtaining respective 8-bit image data for C, M, Y, and K-color printings and 8-bit image data for a gloss control printing (Step S3602).

Then, after the 8-bit gloss control printing data has been output, the TRC 104 of the DFE 3030 performs gamma correction on the 8-bit image data for C, M, Y, and K-color printings by using gamma curves of a 1D_LUT generated by calibration (Step S3603).

Then, the si2 unit 3052 of the DFE 3030 transmits the gamma-corrected 8-bit CMYK image data, the 8-bit gloss control printing data, and table information included in the print job to the server device 3060 (Step S3604), and requests generation of clear-toner printing data.

Figure 20:
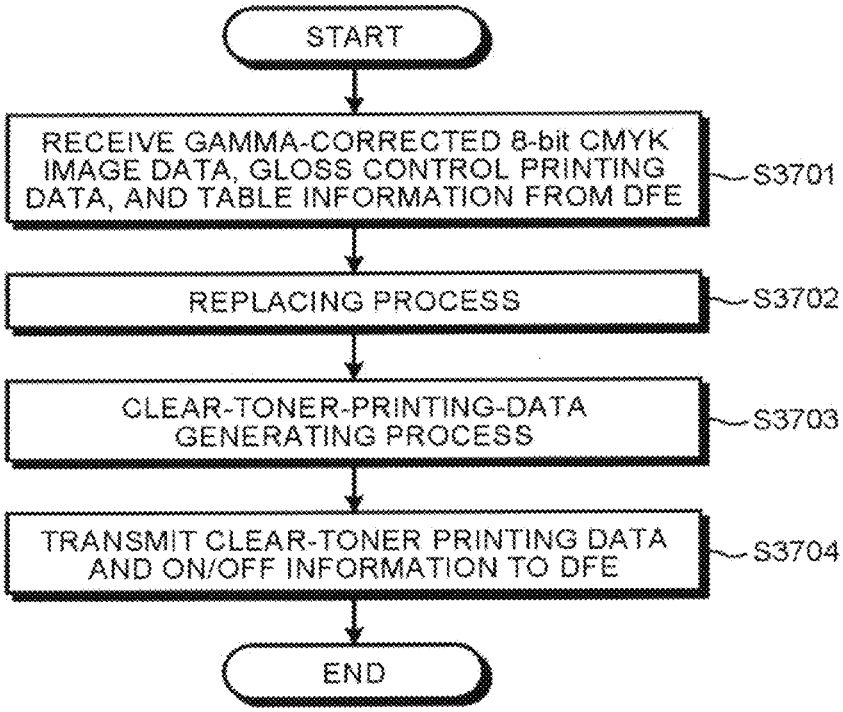
FIG. 20 is a flowchart showing an example of operation of the server device according to the second embodiment.

Here, a process of generating clear-toner printing data (a "clear-toner-printing generating process") performed by the server device 3060 is explained. FIG. 20 is a flowchart for explaining the clear-toner-printing-data generating process performed by the server device 3060. As shown in FIG. 20, when having received the gamma-corrected 8-bit CMYK image data, the gloss control printing data, and the table information from the DFE 3030 (Step S3701), the replacement processing unit 3308 of the server device 3060 performs a process of replacing a default surface-effect selection table stored in the storage unit 3070 (a "replacing process") on the basis of the table information (Step S3702). Contents of this replacing process are the same as the process performed by the replacement processing unit 108 in the first embodiment. Then, the clear processing 3309 of the server device 3060 determines a surface effect with respect to a density value of each of pixels composing the gloss control printing data with reference to the surface-effect selection table stored in the storage unit 3070, and decides to turn the glosser 80 on or off and arbitrarily generates an inverse mask or a solid mask using the chromatic printing data according to the determination, thereby arbitrarily generating clear-toner printing data (Step S3703). Then, the clear-toner printing data and on/off information to specify whether to turn the glosser 80 on or off are transmitted to the DFE 3030 (Step S3704).

To return to FIG. 19 again, continue the explanation. After the above-described Step S3604, the DFE 3030 receives the clear-toner printing data and the on/off information from the server device 3060 (Step S3605). The si3 unit 3054 outputs image data that the clear-toner printing data received from the server device 3060 and halftone-processed 2-bit chromatic printing data processed by the halftone engine 106 are integrated and the on/off information received from the server device 3060 to the MIC 60 (Step S3606).

In this way, in the present embodiment, part of the function of a DFE is provided to the server device 3060, and the above-described replacing process and clear-toner-printing-data generating process are performed by the server device 3060 on a cloud.

Incidentally, in the present embodiment, the single server device 3060 on the cloud is configured to have the functions of the replacing process and the clear-toner-printing-data generating process and perform the replacing process and the clear-toner-printing-data generating process; however, the configuration of the image forming system is not limited to this.

For example, two or more server devices can be placed on a cloud, and the two or more server devices can be configured to perform the replacing process and the clear-toner-printing-data generating process in a decentralized manner.

Furthermore, part or all of the processes performed by the host device 10 and the DEE 3030 can be arbitrarily allocated to one server device on a cloud in a centralized manner or multiple server devices in a decentralized manner.

In other words, it can be configured that any of processes performed by one device are performed by other one or more devices connected to the one device via a network.

Moreover, in the case of "the configuration in which any of processes performed by one device are performed by other one or more devices connected to the one device via a network", the processes performed by the other one or more devices include data input/output processes performed between the one device and the other device(s) and between the other devices, such as a process of outputting data (information) generated in a process performed by the one device from the one device to the other device(s) and a process of the other device(s) receiving the data.

That is, when the number of the other devices is one, the processes include a data input/output process performed between the one device and the other device; when the number of the other devices is two or more, the processes include data input/output processes performed between the one device and the other devices and between the other devices, such as between the first and second other devices.

Furthermore, in the above second embodiment, the server device 3060 is placed on a cloud; however the location of the server device 3060 is not limited to this. For example, one or more server devices, such as the server device 3060, can be placed on any networks, such as an intranet.

Figure 21:
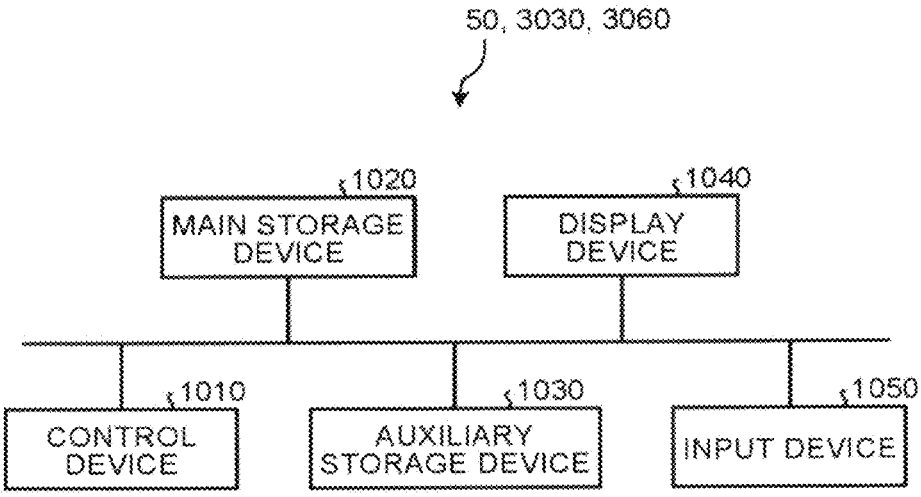
FIG. 21 is a diagram showing a hardware configuration example of the DFE and the server device.

FIG. 21 is a block diagram showing a hardware configuration example of the DFE 50, the DFE 3030, and the server device 3060 according to the above-described embodiments. The DFE 50, the DFE 3030, and the server device 3060 according to the present embodiments include a control device 1010 such as a CPU, a main storage device 1020 such as a read-only memory (ROM) and a RAM, an auxiliary storage device 1030 such as an HDD and a CD drive device, a display device 1040 such as a display, and an input device 1050 such as a keyboard and a mouse, and have a hardware configuration using a general computer.

A control program executed by the DFE 50, the DFE 3030, and the server device 3060 according to the above embodiments is provided in such a manner that the control program is recorded on a computer-readable recording medium, such as a CD-ROM, a flexible disk (FD), a CD-R, or a digital versatile disk (DVD), in an installable or executable file format.

Furthermore, the control program executed by the DFE 50, the DFE 3030, and the server device 3060 according to the above embodiments can be stored on a computer connected to a network such as the Internet, and the control program can be provided by causing a user to download it via the network. Moreover, the control program executed by the DFE 50, the DFE 3030, and the server device 3060 according to the above embodiments can be provided or distributed via a network such as the Internet. Furthermore, the control program executed by the DFE 50, the DFE 3030, and the server device 3060 according to the above embodiments can be built into a ROM or the like in advance.

In the image forming system according to the above embodiments, an image is formed of CMYK toners; however, an image can be formed of one color toner.

Incidentally, a printer system according to the above embodiments is configured to include the MIC 60; however, the configuration of the printer system is not limited to this. Alternatively, the process performed by the MIC 60 and the function of the MIC 60 can be allocated to another device such as the DFE 50 so that the printer system can be configured not to include the MIC 60.

According to the present embodiments, even when gloss control printing data based on a different surface-effect selection table from a pre-implemented surface-effect selection table has been input, it is possible to obtain the same level of print result as an expected print result.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A printing control device that controls a printing device, the printing device being equipped with one or more colored chromatic toners and one or more colorless clear toners and forming an image on a recording medium based on one or more sets of chromatic printing data for attaching the chromatic toners and one or more sets of clear-toner printing data for attaching the clear toners, the printing control device comprising:

a receiving circuit that receives a print job from a host device, the print job including gloss control printing data indicating predetermined density information and table information, the predetermined density information describing a type of surface effect to be achieved on the recording medium and the table information identifying a first surface-effect selection table used, by the host device, in creation of the gloss control printing data, the first surface-effect selection table showing a correspondence relation between the type of surface effect and the predetermined density information; and a replacing circuit that replaces a part of a second surface-effect selection table, stored in the printing control device, according to the table information included in the print job.

2. The printing control device according to claim 1, wherein the table information indicates a non-common part of the first surface-effect selection table other than a common part independent of a type of the printing device, and when the non-common part indicated by the table information is different from a non-common part of the second surface-effect selection table, the replacing circuit replaces the non-common part of the second surface-effect selection table with the non-common part indicated by the table information.

3. The printing control device according to claim 1, wherein the table information indicates a whole of the first surface-effect selection table used in creation of the gloss control printing data included in the print job, and when the first surface-effect selection table indicated by the table information is different from the second surface-effect selection table implemented in the printing control device in advance, the replacing circuit replaces the second surface-effect selection table stored in the printing control device with the first surface-effect selection table.

4. The printing control device according to claim 1, further comprising:

a generating circuit that generates the clear-toner printing data based on the gloss control printing data included in the print job by using the second surface-effect selection table modified by the replacing circuit; and an output circuit that outputs the generated clear-toner printing data.

5. The printing control device according to claim 1, wherein the receiving circuit passes the table information to the replacing circuit, and the replacing circuit replaces the part of the second surface-effect selection table according to the table information.

6. An image forming system, comprising:

a printing control device that controls a printing device, the printing device being equipped with one or more colored chromatic toners and one or more colorless clear toners and controls a printing device which forms an image on a recording medium based on one or more sets of chromatic printing data for attaching the chromatic toners and one or more sets of clear-toner printing data for attaching the clear toners; and a server device that is connected to the printing control device via a network, wherein the printing control device includes a receiving circuit that receives a print job from a host device, the job including gloss control printing data indicating predetermined density information and table information, the predetermined density information describing a type of surface effect to be achieved on the recording medium and the table information identifying a first surface-effect selection table used, by the host device, in creation of the gloss control printing data, the first surface-effect selection table showing a correspondence relation between the type of surface effect and the predetermined density information and a correspondence relation with clear-toner printing data used in the printing device, the server device receives the table information from the printing control device, and the server device includes a replacing circuit that replaces a part of a second surface-effect selection table, stored in the server device, according to the table information.

7. The printing control device according to claim 6, wherein the table information indicates a non-common part of the first surface-effect selection table other than a common part independent of a type of the printing device, and when the non-common part indicated by the table information is different from a non-common part of the second surface-effect selection table, the replacing circuit replaces the non-common part of the second surface-effect selection table with the non-common part indicated by the table information.

8. The image forming system according to claim 6, wherein the table information indicates a whole of the first surface-effect selection table used in creation of the gloss control printing data included in the print job, and when the first surface-effect selection table indicated by the table information is different from the second surface-effect selection table implemented in the printing control device in advance, the replacing circuit replaces the second surface-effect selection table stored in the printing control device with the first surface-effect selection table.

9. The image forming system according to claim 6, wherein the server further includes:

a generating circuit that generates the clear-toner printing data based on the gloss control printing data included in the print job by using the second surface-effect selection table modified by the replacing circuit; and an output circuit that outputs the generated clear-toner printing data.

10. The image forming system according to claim 6, wherein the receiving circuit passes the table information to the replacing circuit via the network, and the replacing circuit replaces the part of the second surface-effect selection table according to the table information.

11. A non-transitory computer-readable medium storing computer readable program codes that, when executed by a printing control device including circuitry, the printing control device controlling a printer device that is equipped with one or more colored chromatic toners and one or more colorless clear toners and controls a printing device which forms an image on a recording medium based on one or more sets of chromatic printing data for attaching the chromatic toners and one or more sets of clear-toner printing data for attaching the clear toners, cause the printing control device to:

receive a print job from a host device, the print job including gloss control printing data indicating predetermined density information and table information, the predetermined density information describing a type of surface effect to be achieved on the recording medium and the table information identifying a first surface-effect selection table used, by the host device, in creation of the gloss control printing data, the first surface-effect selection table showing a correspondence relation between the type of surface effect and the predetermined density information and a correspondence relation with clear-toner printing data used in the printing device; and replace a part of a second surface-effect selection table, stored in the printing control device, according to the table information included in the print job.

12. The non-transitory computer-readable medium according to claim 11, wherein the table information indicates a non-common part of the first surface-effect selection table other than a common part independent of a type of the printing device, and when the non-common part indicated by the table information is different from a non-common part of the second surface-effect selection table, the printing control device is further caused to replace the non-common part of the second surface-effect selection table with the non-common part indicated by the table information.

13. The non-transitory computer-readable medium according to claim 11, wherein the table information indicates a whole of the first surface-effect selection table used in creation of the gloss control printing data included in the print job, and when the first surface-effect selection table indicated by the table information is different from the second surface-effect selection table implemented in the printing control device in advance, the printing control device is further caused to replace the second surface-effect selection table stored in the printing control device with the first surface-effect selection table.

14. The non-transitory computer-readable medium according to claim 11, wherein the printing control device is further caused to:

generate the clear-toner printing data based on the gloss control printing data included in the print job by using the replaced second surface-effect selection table; and output the generated clear-toner printing data.

* * * * *